US006375297B1

(12) United States Patent
Hayashi et al.

(10) Patent No.: US 6,375,297 B1
(45) Date of Patent: Apr. 23, 2002

(54) PRINTER, PRINTING SYSTEM, RECORDING MEDIUM FOR STORING PRINT CONTROL PROGRAMS, AND PRINTING METHOD

(75) Inventors: Toshihiro Hayashi; Yoshihiko Matsuzawa, both of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/384,056

(22) Filed: Aug. 27, 1999

(30) Foreign Application Priority Data

Aug. 27, 1998 (JP) ..... 10-242351
Oct. 27, 1998 (JP) ..... 10-305882
Jul. 13, 1999 (JP) ..... 11-198990

(51) Int. Cl.[7] ..... B41J 29/38
(52) U.S. Cl. ..... 347/14
(58) Field of Search ..... 347/8, 101, 104, 347/37, 14, 15, 19; 400/55, 56, 323, 323.1

(56) References Cited

U.S. PATENT DOCUMENTS 5,940,092 A * 8/1999 Kashimura et al. ..... 347/8
5,988,784 A * 11/1999 Takemura et al. ..... 347/37
6,128,098 A * 10/2000 Kamada et al. ..... 347/15

FOREIGN PATENT DOCUMENTS

JP 60-217165 10/1985 ..... B41J/3/10
JP 4-151252 5/1992 ..... B41J/2/13
JP 11-48468 2/1999 ..... B41J/2/01

* cited by examiner

*Primary Examiner*—N. Le
*Assistant Examiner*—R. Feggins
(74) *Attorney, Agent, or Firm*—Sughrue Mion PLLC

(57) ABSTRACT

Before transmitting print data, a print controller transmits to a printer information on a thickness of a printing medium corresponding to a sort of printing medium which is selected on a select screen by an operator in a state that the medium thickness information is contained in control data for the print data. In the printer, a timing correction section corrects a timing of ejecting an ink drop onto a printing medium in the forward and reverse scans executed by the recording head in accordance with the control data containing the medium thickness information. Accordingly, stress imposed on the operator when the printer prints on various types of printing media in a bi-directional printing mode can be reduced.

31 Claims, 18 Drawing Sheets

FIG. 5

301

| PRINT SPEED | 200CPS | 300CPS |
|---|---|---|
| d1a | * * μm | * * μm |

302

| PRINT QUALITY | DRAFT | STANDARD | HIGH RESOLUTION |
|---|---|---|---|
| d1b | * * μm | * * μm | * * μm |

303

| INK SORT | DYE FAMILY | PIGMENT FAMILY |
|---|---|---|
| d1c | * * μm | * * μm |

FIG. 6

| PRINT SPEED | | 200 CPS | | 300 CPS | |
|---|---|---|---|---|---|
| INK SORT | | DYE FAMILY | PIGMENT FAMILY | DYE FAMILY | PIGMENT FAMILY |
| PRINT QUALITY | DRAFT | TABLE (1) | TABLE (2) | TABLE (3) | TABLE (4) |
| | STANDARD | TABLE (5) | TABLE (6) | TABLE (7) | TABLE (8) |
| | HIGH RESOLUTION | TABLE (9) | TABLE (10) | TABLE (11) | TABLE (12) |

TABLE (i) $1 \leq i \leq 12$

| | | | | | |
|---|---|---|---|---|---|
| P-T | ** mm | ** mm | ** mm | ** mm | ** mm |
| d2 | ** μm | ** μm | ** μm | ** μm | ** μm |

FIG. 7

| PRINT SPEED | | 200 CPS | | 300 CPS | |
|---|---|---|---|---|---|
| INK SORT | | DYE FAMILY | PIGMENT FAMILY | DYE FAMILY | PIGMENT FAMILY |
| PRINT QUALITY | DRAFT | TABLE (1) | TABLE (2) | TABLE (3) | TABLE (4) |
| | STANDARD | TABLE (5) | TABLE (6) | TABLE (7) | TABLE (8) |
| | HIGH RESOLUTION | TABLE (9) | TABLE (10) | TABLE (11) | TABLE (12) |

TABLE (i) $1 \leq i \leq 12$

| P-T | | ** mm | ** mm | ** mm | ** mm | ** mm |
|---|---|---|---|---|---|---|
| TEMPERATURE | $Th < Th1$ | ** μm | ** μm | ** μm | ** μm | ** μm |
| | $Th1 \leq Th \leq Th2$ | ** μm | ** μm | ** μm | ** μm | ** μm |
| | $Th2 < Th$ | ** μm | ** μm | ** μm | ** μm | ** μm |

$$D_0 = \frac{D_1H_2 - D_2H_1}{H_2 - H_1}$$

$$\text{GRADIENT: } \frac{D_1 - D_2}{H_1 - H_2}$$

PRINTER, PRINTING SYSTEM, RECORDING MEDIUM FOR STORING PRINT CONTROL PROGRAMS, AND PRINTING METHOD

BACKGROUND OF THE INVENTION

The present invention relates to a printer with a recording head capable of ejecting an ink drop, and more particularly to a called bi-directional printer capable of printing on a printing medium in both a forward scan and a reverse scan by the recording head.

In the printer with a recording head for ejecting an ink drop, there are proposed techniques to curb an elongation of a printing time, which results from the size increase of a printing medium and the definition increase of a print image. An example of the technique is a bi-directional printing technique in which the printer prints on a printing medium in both the scanning directions of a forward scan and a reverse scan, which are performed by the recording head.

In the printer using such a technique, i.e., the called bi-directional printer, when an ink drop is ejected at the same timing (same ejection positions) in both the forward scan and the reverse scan, printing positions in the forward and reverse scans are off-set from each other. As shown in FIG. 19A, an ink ejection direction is expressed by a composite vector of a vector Vm, Vm' (moving velocity vector) representative of a moving velocity of the recording head 1003 and a vector Vj (ejecting velocity vector) representative of an ink ejecting velocity of an ink drop ejected from the recording head 1003. Where the timing of ejecting an ink drop in the forward scan F is the same as that of ejecting an ink drop in the reverse scan R, the direction of ejecting an ink drop in the forward scan will be different from that in the reverse scan since a direction of the moving velocity Vm of the recording head in the forward scan is different from direction of the moving velocity Vm' in the reverse scan. As a result, a printing position on the printing medium in the forward scan is different from that in the reverse scan (PO in the figure).

To cope with this, in design, an ink ejection position JP in the forward scan F is off-set from that JP' in the reverse scan R so as to secure the coincidence of the printing positions in the forward scan and in the reverse scan at PP as shown in FIG. 19B. Further, a function to print a test pattern, which is used for detecting a printing-position off-set between the forward scan and the reverse scan is incorporated into the printer. To correct the printing-position off-set, an operator prints out the test pattern. He adjusts elevation of the recording head 1003 and the platen 1002 while referring the print result of the test pattern, to thereby set up a proper distance from the ink ejecting surface of the recording head to the printing surface of the printing medium 1001.

Precision improvement in the paper feeding/discharging mechanism of the recent printer enables the printer to print on various types of printing media. Where the bi-directional printer prints on various types of printing media, the apparatus will meet the medium thickness difference. When the medium thickness difference exists, the distance from the ink ejecting surface of the recording head to the printing surface of the printing medium inevitably changes. An influence of the distance change upon the printing-position off-set is not negligible.

Let us consider a case where identical images are formed on a normal paper sheet and a post card (1010 in FIG. 19B). In this case, the normal paper sheet has a thickness of about 0.1 mm thick and the post card has a thickness of about 0.2mm. One of the normal paper sheet and the post card (or a printing medium having a thickness value between those values of them) is used for a reference for correcting the printing-position off-set, and the distance from the ink ejecting surface of the recording head to the printing surface of the printing medium is adjusted to as to correct the off-set. Then, the printer prints on the other sheet (both the sheets when the printing medium of the medium thickness is used for the reference). In this case, an off-set of the printing position in the forward scan from the printing position in the reverse scan is not so distinguished.

Let us consider another case where identical images are printed on thick printing media of about 1.5 mm thick, such as label sheets and thick sheets, in addition to the normal paper sheets and the post cards. The normal paper sheet or the post card is used for a reference for correcting the printing-position off-set, and the distance from the ink ejecting surface of the recording head to the printing surface of the printing medium is adjusted to as to correct the off-set. In this case, a great printing-position off-set PO' is created when the printer prints on those thick printing media (1011 in FIG. 19B).

The related bi-directional printer is not designed such that it can handle various types of printing media of different thickness values. To correct the printing-position off-set, the related printer takes the following tasks: every time a printing medium having a different thickness is set to the printer, a test pattern is printed on the printing medium set anew; and an operator adjusts a position of the platen and/or recording head on the basis of the print result of the test pattern to set up a proper distance from the ink ejecting surface of the recording head to the printing surface of the printing medium. Following those tasks, the printer prints on the printing medium. The execution of those tasks is complicated and troublesome, and imposes heavy on the operator.

A viscosity of ink varies with variation of temperature. A variation of the viscosity of ink results in a velocity of ejecting an ink drop from the recording head. Normally, the recording head per se has a temperature-dependency. Therefore, when temperature of the recording head varies, the ink ejecting velocity also varies. Thus, an ink ejection direction is expressed by a composite vector of the moving velocity vector of the recording head and the ejecting velocity vector of the ejecting ink drop. Therefore, when the ink ejecting velocity varies, the ink ejecting direction varies. This yields a printing-position off-set between the forward scan and the reverse scan.

Some of recent bi-directional printer are capable of printing on a printing medium of large size, e.g., A0. To print on a large size printing medium by use of the bi-directional printer, the printing is contiguously performed for a relatively long time. During the long printing operation, temperature of the recording head varies and an ink ejecting direction varies. Therefore, the following expedience is inevasible. Even if the ink-ejection timing is corrected so as to eliminate the printing-position off-set between the forward and reverse scans by the recording head before printing on the printing medium starts, a temperature variation of the recording head during the printing operation inevitably yields a printing-position off-set between the forward and reverse scans.

SUMMARY OF THE INVENTION

For the above background reasons, the present invention is made and has an object to lessen stress imposed upon the operator when bi-directional printing on various types of printing media are carried out. The invention has another object to obviate a printing-position off-set between the forward scan and the reverse scan, which arises from the temperature-dependency of the recording head and ink used.

In order to achieve the above object, according to a first aspect of the present invention, there is provided a printer capable of printing on a printing medium in both a forward scan and a reverse scan by a recording head for ejecting ink drops, comprising- interface means for acquiring control information containing at least information on a thickness of the printing medium; and timing correction means for correcting timings of ejecting ink drops toward the printing medium during at least one of the forward and reverse scans in accordance with the thickness information of the printing medium contained in the control information acquired by the interface means.

The interface means may be input means, e.g., an operation panel, for receiving control information entered by an operator: It may be a variety of sensors for sensing temperature and sheet thickness or means for acquiring control information from a print controller (for transmitting print data) connected to a printer by way of a communication line.

The printer acquires control information automatically or an operator by use of the interface means. The timing correction means corrects timings of ejecting ink drops toward the printing medium during at least one of the forward and reverse scans in accordance with a distance from an ink ejecting surface of the recording head to a printing surface of the printing medium, which the distance is determined by the thickness information of the printing medium contained in the control information acquired by the interface means. An advantageous feature of the thus constructed printer is to lessen stress imposed to the operator when comparing with a case where the related bi-directional printer prints on various types of printing media of different thickness in a bi-directional printing mode.

Preferably, the control information contains information on an ink ejecting velocity and information on a moving velocity of the recording head. The timing correction means corrects timing of ejecting ink drops to the printing medium in accordance with a distance from an ink ejecting surface of the recording head to a printing surface of the printing medium, which the distance is determined by the thickness information of the printing medium contained in the control information received from the print controller, and an ink ejecting direction specified by the information on the ink ejecting velocity and the moving velocity of the recording head.

This technical feature advantageously operates in a situation where an ink ejecting velocity and a moving velocity of the recording head are varied in accordance with a sort of printing medium to be used. In this situation, a timing of ejecting an ink drop on a printing medium can be corrected so as to correct a printing-position off-set between the forward and reverse scans. Thus, the printing-position off-set can be corrected with high precision.

According to a second aspect of the present invention, there is provided a printer capable of printing in both a forward scan and a reverse scan by a recording head for ejecting ink drops, comprising: storing means for storing a mathematical expression describing a relation of a thickness of the printing medium with an ejection-timing correction quantity during at least one of the forward and reverse scans; correction-quantity calculating means for calculating an ejection-timing correction quantity dependent on a thickness of the printing medium to be under printing by use of the expression; and timing control means for controlling a timing to eject an ink drop onto the printing medium to be under printing in at least one of the forward and reverse scans in accordance with an ejection-timing correction quantity calculated by the correction-quantity calculating means.

The printer may include means, e.g., an operation panel, for receiving the medium-thickness information entered by an operator. The thickness information of the printing medium to be under printing may be acquired by use of the reception means. Alternatively, it may be received from a print controller (for transmitting print data) connected to a printer by way of a communication line. In a second alternative, the medium thickness information may be acquired by use of a sensor, which is provided for detecting a thickness of a printing medium set on a platen.

In the printer, a mathematical expression is prepared in advance which describes a relation between a thickness of a printing medium, which specifies a distance between the ink ejecting surface of the recording head and the printing surface of the printing medium, and an ejection-timing correction quantity in at least one of the forward and reverse scans. The printer calculates an ejection-timing correction quantity which is dependent on a distance between the ink ejecting surface of the recording head and the printing surface of the printing medium, which the distance is specified by a thickness of a printing medium to be under printing, by use of the expression, and corrects a timing of ejecting an ink drop to the printing medium in at least one of the forward and reverse scans in accordance with the calculated ejection-timing correction quantity.

With the use of the mathematical expression, the printer corrects an off-set of the printing position in the forward scan relative to that in the reverse scan, which arises from the bi-directional printing applied to various types of printing media of different thickness. Therefore, the thus constructed printer is capable of lessening stress imposed to the operator when comparing with a case where the related bi-directional printer prints on various types of printing media of different thickness in a bi-directional printing mode.

The ejection-timing correction quantity for a thickness of a printing medium to be under printing is calculated by use of the mathematical expression prepared in advance. Because of this, a memory capacity of the memory for storing the ejection-timing correction quantity may be reduced when comparing with a case of storing in advance the ejection-timing correction quantities prepared for various types of printing media of different thickness.

The mathematical expression may be constructed by calculating ejection-timing correction quantities to correct printing-position off-set each between the forward scan and the reverse scan at least two different distances each from the ink ejection surface of the recording head to the printing surface of the printing medium.

The mathematical expression is expressed by $$D = \frac{D_1 - D_2}{H_1 - H_2} H + \frac{D_1 H_2 - D_2 H_1}{H_2 - H_1}$$

where

D: ejecting-timing correction quantity to be calculated;

H: distance from the ink ejection surface of the recording head to the printing surface of the printing medium to be under printing (viz., the printing medium for which the ejection-timing correction quantity is to be calculated) (The distance H is determined by a printing medium to be under printing.);

$D_1$: ejecting-timing correction quantity when a distance from the ink ejection surface of the recording head to the printing surface of the printing medium is $H_1$; and $D_2$: ejecting-timing correction quantity when a distance from the ink ejection surface of the recording head to the printing surface of the printing medium is $H_2$.

For example, when a distance (platen gap) from the ink ejecting surface of the recording head to the platen is fixed at P, the printer prints on two types of printing media (reference sheets) of different thickness values $T_1$ and $T_2$, and calculates ejection-timing correction quantities $D_1$ and $D_2$ to correct the printing-position off-set between the forward scan and the reverse scan for the reference sheets. Here, the distance from the ink ejecting surface of the recording head to the printing surface of the printing medium is equal to the result of subtracting a thickness of the printing medium from the platen gap. The above mathematical expression can be arranged into $$D = \frac{D_1 - D_2}{(P - T_1) - (P - T_2)}(P - T) + \frac{D_1(P - T_2) - D_2(P - T_1)}{(P - T_2) - (P - T_1)}$$

where

T: thickness of a printing medium to be under printing (viz., the printing medium for which the ejection-timing correction quantity is to be calculated).

For example, when the platen gap may be set to $P_1$ or $P_2$ by moving the platen or the recording head, the printer prints a printing medium (reference sheet) of a thickness value $T_1$ at the platen gaps $P_1$ and $P_2$ in a bi-directional printing mode, and calculates ejection-timing correction quantities $D_1$ and $D_2$ to correct the printing-position off-sets each between the forward scan and the reverse scan. Since the distance from the ink ejecting surface of the recording head to the printing surface of the printing medium is equal to the result of subtracting the medium thickness from the platen gap, the above mathematical expression may be arranged into $$D = \frac{D_1 - D_2}{(P_1 - T_1) - (P_2 - T_1)}(P - T) + \frac{D_1(P_2 - T_1) - D_2(P_1 - T_1)}{(P_2 - T_1) - (P_1 - T_1)}$$

where

P: platen gap value ($P_1$ or $P_2$) used for printing on the printing medium to be under printing.

According to a third aspect of the present invention, there is provided a printer capable of printing on a printing medium in both a forward scan and a reverse scan by a recording head for ejecting ink drops, comprising: temperature detecting means for detecting temperature of the recording head; and timing correction means for correcting a timing of ejecting an ink drop to the printing medium in at least one of the forward and reverse scans in accordance with the temperature of the recording head detected by the head temperature detecting means.

The printer detects temperature of the recording head by temperature detecting means. The timing correction means corrects a timing of ejecting an ink drop to the printing medium in at least one of the forward and reverse scans in accordance with an ink ejecting direction to the printing medium, which is specified by the temperature of the recording head detected by the head temperature detecting means. Therefore, the printer can obviate a printing-position off-set between the forward scan and the reverse scan, which arises from the temperature-dependency of the recording head and ink used.

The printer may include home-position detecting means for detecting that the recording head reaches a home position. In this case, when the home-position detecting means for detecting that the recording head reaches a home position, the timing correction means corrects a timing of ejecting an ink drop to the printing medium in at least one of the forward and reverse scans in accordance with the temperature of the recording head detected by the head temperature detecting means.

Accordingly, every time the recording head reaches the home position, the ink ejection timing is corrected in accordance with a head temperature at that time. In other words, every time the recording head moves forward and returns to the home position, the ink ejection timing is corrected on the basis of the newest recording head temperature. Therefore, the printer can obviate a printing-position off-set between the forward scan and the reverse scan in the bi-directional printing mode.

BRIEF DESCRIPTION OF THE DRAWINGS

In the accompanying drawings:

FIGS. 5 to 7 are diagrams showing tables contained in the timing correction section 231 of the printer 2 shown in FIG. 1;

DETAILED DESCRIPTION OF THE PREFERRED EMBODIMENTS

The preferred embodiments of the present invention will be described with reference to the accompanying drawings.

A first embodiment of the present invention will first be described.

Figure 1:
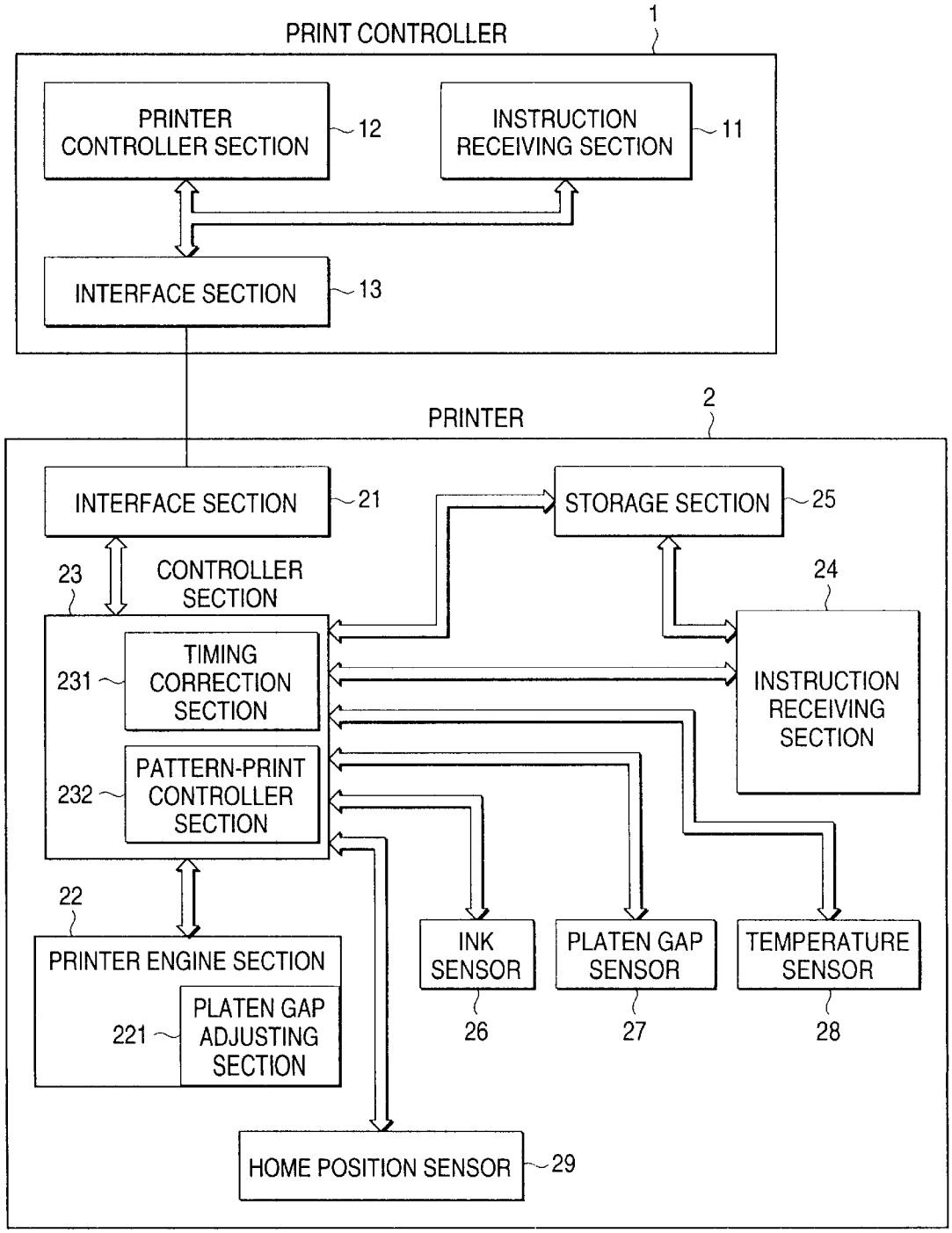
FIG. 1 is a block diagram showing a configuration of a printing system according to a first embodiment of the present invention.

FIG. 1 is a block diagram showing a configuration of a printing system according to a first embodiment of the present invention.

As shown, the printing system is composed of a print controller 1 and an ink jet printer 2.

The print controller 1 is made up of an instruction receiving section 11 for receiving an instruction from an operator through a display screen, a printer controller section 12 for generating print data and control data for the print data, and an interface section 13 interfacing with the printer 2 for data transfer to and from the latter.

Figure 2:
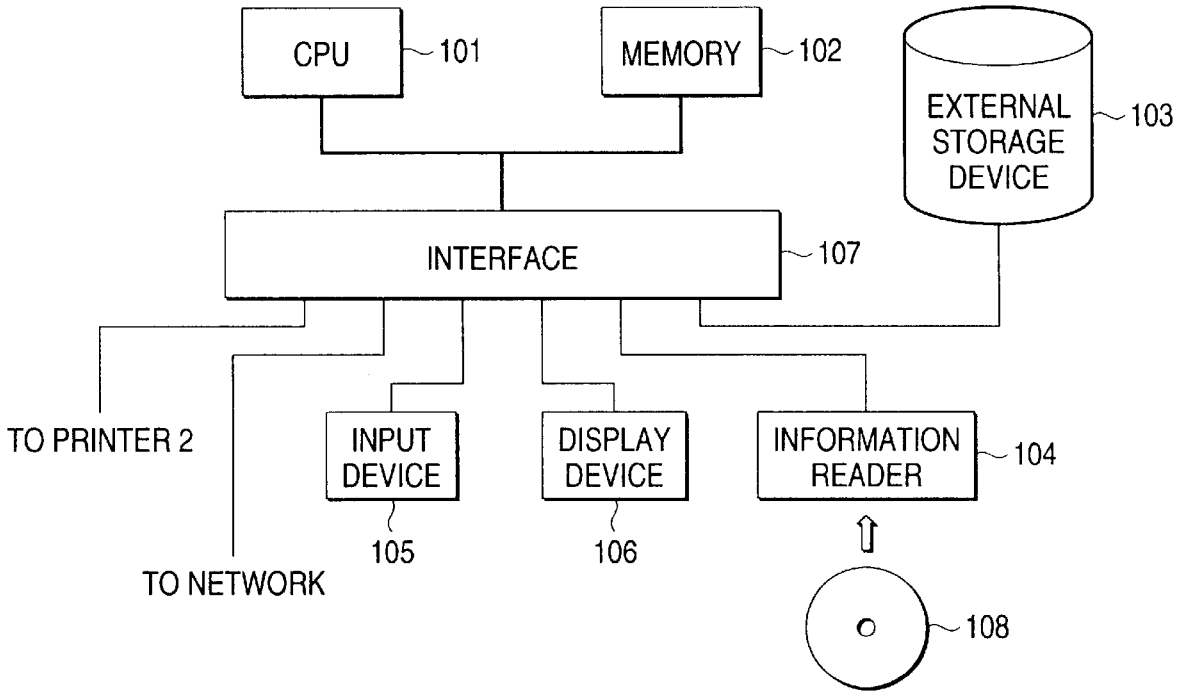
FIG. 2 is a block diagram showing a hardware configuration of the printer shown in FIG. 1.

The print controller 1 may be arranged as shown in FIG. 2. The print controller 1 may be a general information processor, such as a personal computer, which includes a CPU 101, a memory 102, an external storage device 103, such as a hard disc, an information reader 104 for reading out information from a portable, information recording medium 108, such as FD or CD-ROM, an input device 105, such as a keyboard or a mouse, a display device 106, and an interface 107 interfacing with a network, e.g., an internet the printer 2, the external storage device 103, the information reader 104, the input device 105, the display device 106, the CPU 101, and the memory 102. The image processor thus constructed in hardware is arranged into a process in a manner that a print control program (printer driver), which is stored in the portable information recording medium 108, is loaded into the external storage device 103 by use of the information reader 104, and it is loaded from the external storage device 103 into the memory 102 and executed by the CPU 101, or that the printer driver is down-loaded through a network into the external storage device 103, and it is loaded, as occasion demands, from the external storage device 103 into the memory 102 or directly down-loaded into the memory 102, and it is executed by the CPU 101.

The instruction receiving section 11 drives the print controller 1 as the information processor before printing commences (transmission of print data), and in turn the print controller 1 drives its display device to display a selection screen, which contain options of sizes and sorts of printing media, print quality modes (normal mode/high resolution mode), printing speed (moving velocity of the recording head), and others. The selection screen is presented to a printer operator or user for selection of his or her desired options.

Figure 3:
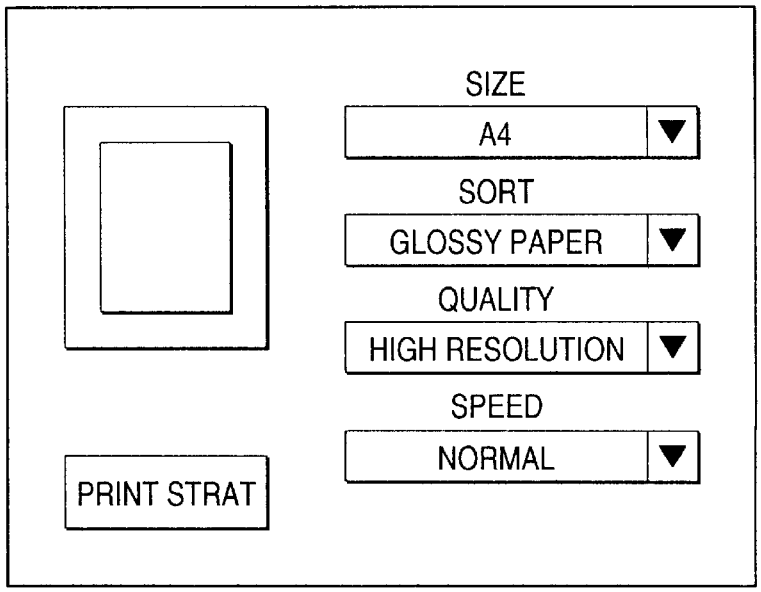
FIG. 3 is a diagram showing an exemplar select screen formed by the instruction receiving section 11 in the print controller 1.

An example of the selection screen presented in response to the instruction from the instruction receiving section 11 is shown in FIG. 3.

As shown, the selection screen contains option keys for medium size and sort, print quality and printing speed. The operator select his desired options and then pushes a print start key. Then, the conditions for the selected options are output to the print controller 1.

The printer controller section 12 responds to a print start instruction received by the instruction receiving section 11, and generates print data to the printer 2. The printer controller section 12 contains a table (not shown) in which sorts and thickness values of printing media are tabulated in a corresponding fashion. It reads out a medium thickness associated with a sort of the printing medium received by the instruction receiving section 11, and transfers the medium thickness information as control information for the generated print data to the interface section 13. At this time, the information on the medium size and print quality mode, which are received by the instruction receiving section 11, are also transferred as the control information to the same. Subsequently, the generated print data is transferred to the interface section 13.

The printer 2, as shown in FIG. 1, is made up of an interface section 21 interfacing with the print controller 1, a printer engine section 22, a controller section 23 for controlling the printer engine section 22 so that it prints on the printing medium in a bi-directional printing mode in accordance with the print data, an instruction receiving section 24 for receiving an instruction from the operator, a storage section 25 as a nonvolatile rewritable memory, e.g., NVRAM, and sensors 26 to 29 for sensing various states of the printer 2. The printer engine section 22 referred to above includes a recording head for ejecting ink drops, a platen, a carriage drive mechanism for driving a carriage for carrying the recording head, a sheet feeding mechanism, and a sheet supply/discharge mechanism for supplying sheets of printing media to and discharging the same from the printer 2.

Figure 4A:
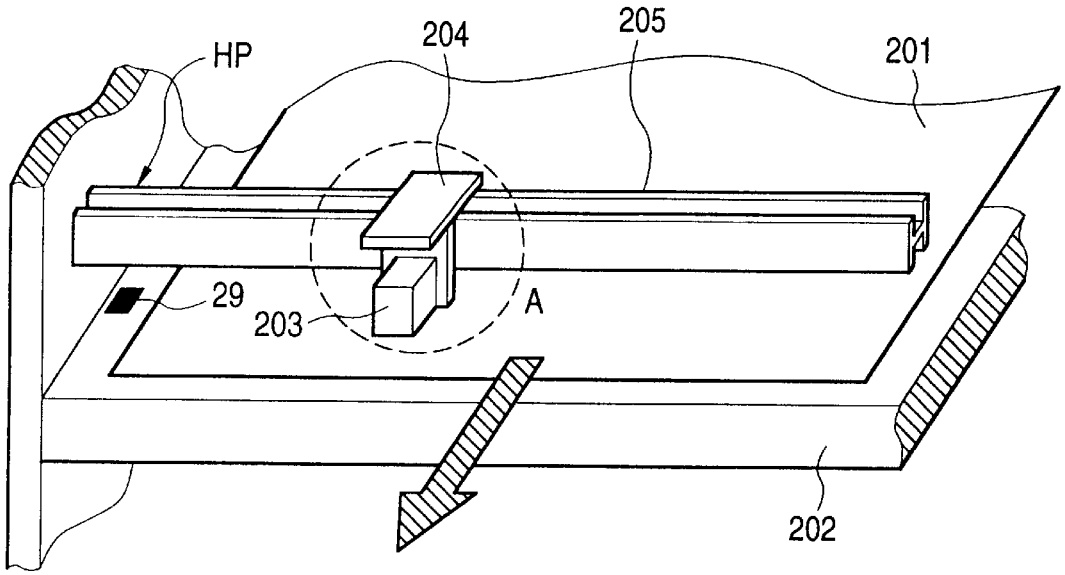
FIGS. 4A and 4B are views showing a structure including a part of the printer engine section 22 in the printer 2 and various types of sensors 26 to 29.
Figure 4B:
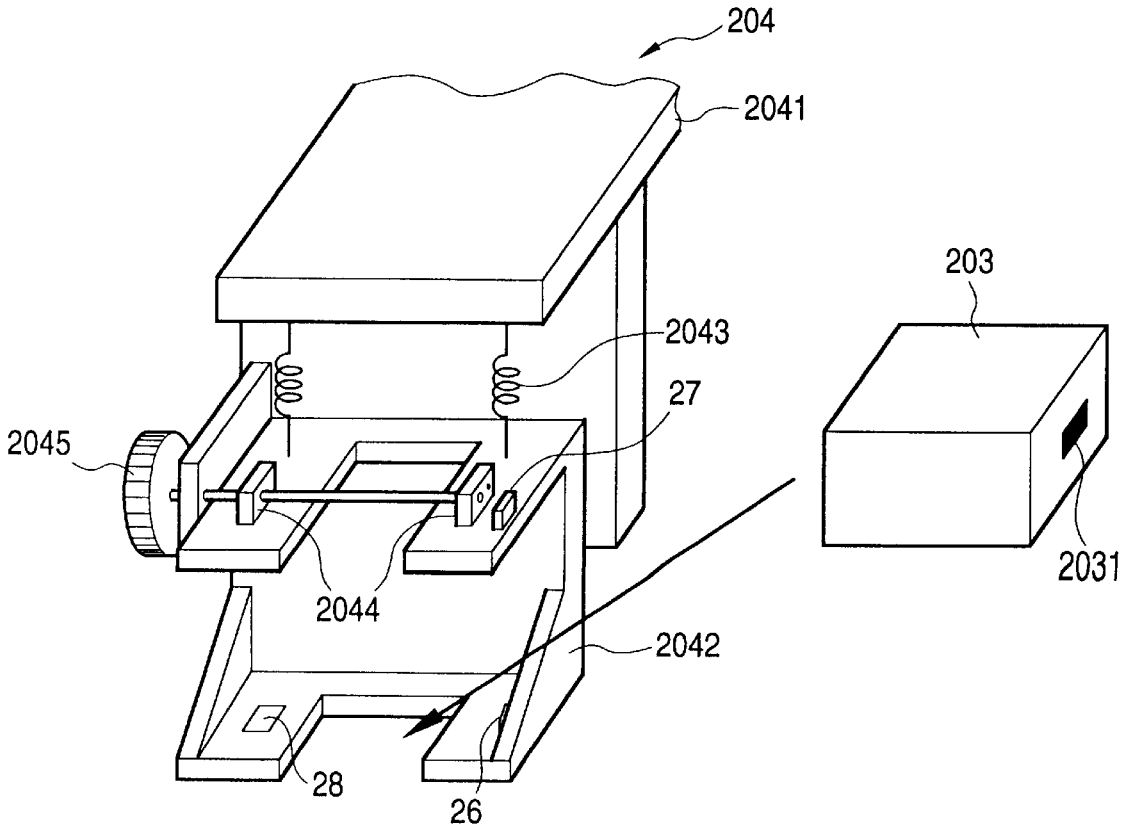

The printer engine section 22 includes a platen gap adjusting section 221 for adjusting a gap from an ink ejecting surface of the recording head to the platen. FIGS. 4A and 4B schematically show a structure containing a part of the printer engine section 22 and the sensors 26 to 29.

As shown in FIG. 4A, a printing medium 201 is supported on a platen 202, and fed in an arrow direction by means of sheet-feeding and supply/discharge mechanisms (not shown). A recording head 203 is held by a carriage 204. The carriage 204 is moved on and along a carriage rail 205 by means of a carriage drive mechanism (not shown). The sensor 29 is a home position sensor and consists of a photo sensor. It senses an arrival of the carriage 204 at the home position, and sends its output signal to the controller section 23.

As shown in FIG. 4B, the carriage 204 includes a carriage body 2041 used for its movement on and along the carriage 204 and a head holder 2042 for holding the recording head 203 therein.

The head holder 2042 is suspended from the carriage body 2041 by means of lifting springs 2043 in a state that elevation of the carriage body 2041 may be adjusted by positioning cam member 2044. The sensor 27 is a platen gap sensor and consists of a photo sensor. It detects a status of positioning cam means 2044 by detecting a mark on the positioning cam means 2044. A detected cam state is transferred to the controller section 23. The storage section 25 stores a table in which cam states and platen gap values are tabulated in corresponding fashion. The controller section 23 looks up a platen gap value associated with a cam state detected by the platen gap sensor 27 in the table stored in the storage section 25.

The positioning cam means 2044 is coupled to a cam drive gear 2045. At the home position, the cam drive gear 2045 is in mesh with another gear (not shown), and is rotated in this state. When receiving a platen gap adjust instruction from the operator through the instruction receiving section 24, the controller section 23 informs the platen gap adjusting section 221 of the instruction receiving. The platen gap adjusting section 221 rotates, in accordance with the instruction, the cam drive gear 2045 which in turn drives the positioning cam means 2044, when the carriage 204 is at the home position (the controller can know this carriage position by a signal from the home position sensor 29 ). The result is to adjust a platen gap. In the platen gap adjustment, the platen gap is set at a platen gap value $P_1$ or $P_2$ in this instance.

The sensor 26 as an ink sensor 26 (photo sensor) and the sensor 28 as a thermal sensor 28 are attached to the head holder 2042. An ID code 2031 is attached to the recording head 203. When the recording head 203 is set to the head holder 2042, the ink sensor 26 reads out the ID code 2031, and sends the readout code to the controller section 23. A table showing the correspondence between ID codes and sorts of ink is stored in the storage section 25. The controller section 23 looks up a sort of ink to be ejected from the recording head 203, which has been loaded to the head holder 2042, in the table by use of the ID code detected by the ink sensor 26. The thermal sensor 28 is located at a position near to the nozzle orifices of the recording head 203 loaded into the head holder 2042. The sensor 28 senses a temperature of the recording head 203 and sends the sensed one to the controller section 23.

The controller section 23, as shown in FIG. 1, includes a timing correction section 231 and a test-pattern-print controller section 232.

Figure 19A:
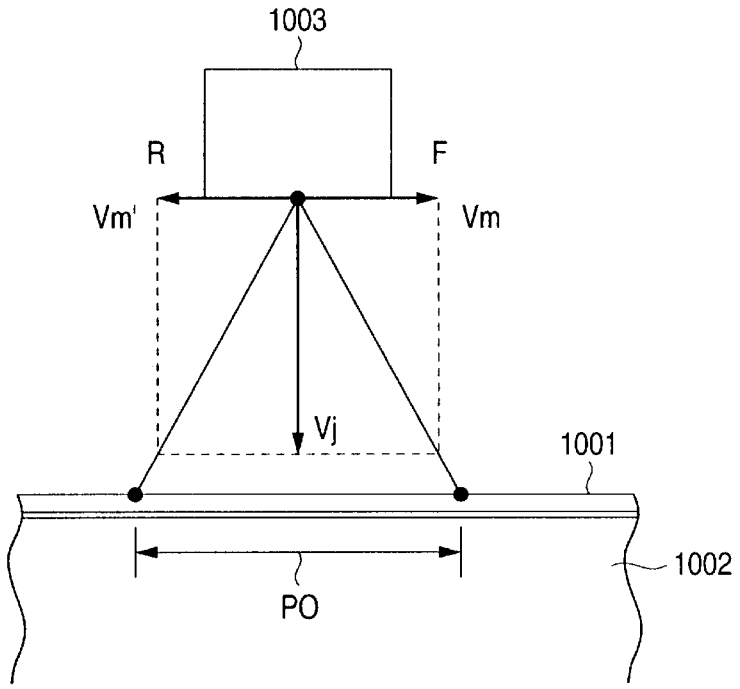
FIGS. 19A and 19B are diagrams for explaining a printing-position off-set between the forward scan and the reverse scan, which arises from the medium thickness difference.
Figure 19B:
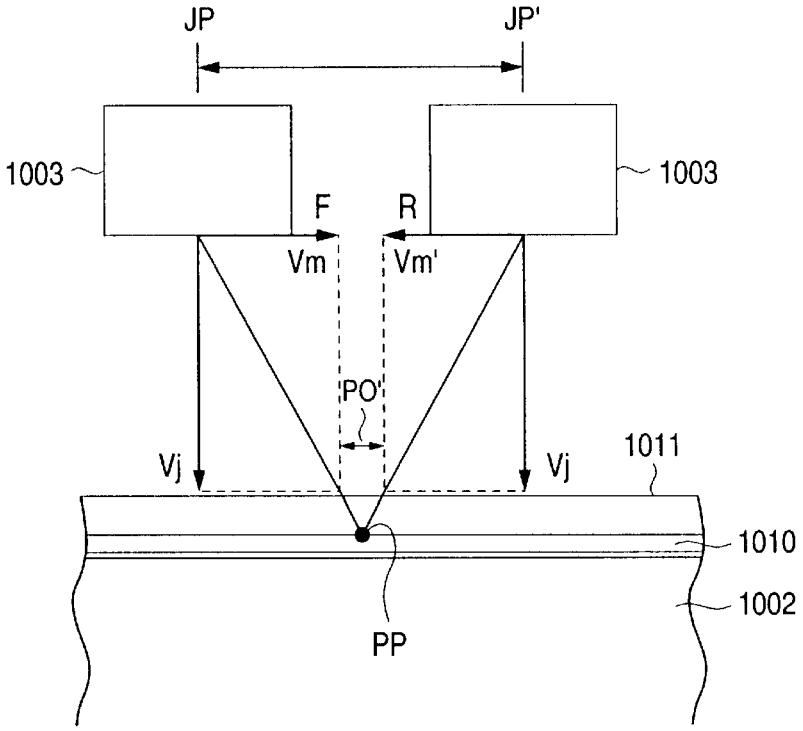

The timing correction section 231 calculates a quantity of a correction of an ink ejection timing in the reverse scan with respect to an ink ejection timing in the forward scan (i.e., a quantity of an off-set J–J' of an ink ejecting position in the reverse scan from an ink-ejecting position in the forward scan; shown in FIG. 19B), and corrects an ink ejection timing of the recording head in the reverse scan with respect to the ink ejection timing in the forward scan in accordance with the calculated ejection-timing correction quantity.

The ejection-timing correction quantity D for an ink ejection timing of the recording head in the reverse scan with respect to an ink ejection timing in the forward scan is given by $$D=d1+d2+d3$$

where d1: ejection-direction correction quantity; d2: sheet-thickness correction quantity; and d3 temperature correction quantity.

The ejection-direction correction quantity d1 is determined by an ink ejection velocity and a recording head moving velocity. As already described, a direction of ejecting an ink drop is expressed by a composite vector of an ink ejection velocity vector and a moving velocity vector of the recording head: Therefore, if an ink ejection velocity or a recording head moving velocity vary, the ink ejection direction also varies, and hence an off-set quantity of the printing position between the forward scan and the reverse scan by the recording head varies. To cope with this, the present embodiment varies a correction quantity of an ink drop ejection timing in the reverse scan with respect to an ink drop ejection timing in the forward scan by use of information concerning (affecting) the ink ejection velocity and the recording head moving velocity, such as printing speed, print quality mode, and sort of ink.

The storage section 25 stores tables as shown in FIG. 5; a first table 301 (FIG. 5A) tabulating printing speed (moving velocity of the recording head) vs. correction quantity, a second table 302 (FIG. 5B) tabulating print quality mode vs. correction quantity, and a third table 303 (FIG. 5C) tabulating sort of ink vs. correction quantity.

The timing correction section 231 reads out correction quantities from those tables 301 to 303 by use of information on printing speed (e.g., 300 cps/200 cps) contained in the control data, which is received from the print controller 1 through the interface section 21, information on the print quality mode (e.g., draft/standard/high resolution), and information on the sorts of ink (e.g., dye/pigment) received from the ink sensor 26. Then, the timing correction section 231 sums the readout correction quantities and uses it as an ejection-direction correction quantity d1.

The correction quantities stored in the tables 301 to 303 (FIG. 5) may be determined empirically. The print quality modes and the sorts of ink are put in predetermined conditions (default values), and in this state, ink ejection-timing correction quantities to minimize the printing-position off-set between the forward scan and the reverse scan are empirically obtained at the printing speeds at which the printer 2 is operable, and the resultant quantities are stored in the first table 301. Similarly, the printing speed and the sorts of ink are put in predetermined conditions (default values), and in this state, ink ejection-timing correction quantities to minimize the printing-position off-set between the forward scan and the reverse scan are empirically obtained at the print quality modes in which the printer 2 is operable, and the resultant quantities are stored in the second table 302. Further, the printing speed and the print quality modes are put in predetermined conditions (default values), and in this state, ink ejection-timing correction quantities to minimize the printing-position off-set between the forward scan and the reverse scan are empirically obtained at the sorts of ink which can be used by the printer 2, the resultant quantities are stored in the first table 301. In this way, the tables 301 to 303 shown in FIG. 5 can be prepared.

The sheet-thickness correction quantity d2 is determined by a distance from the ink ejection surface of the recording head to the printing surface of the printing medium. The printing position on the printing medium varies when the distance from the ink ejection surface of the recording head to the printing surface of the printing medium varies, even if the ink ejection velocity and the moving speed of the recording head, viz., the ink ejection direction, are invariable. Therefore, a variation of the distance from the ejecting-surface to the printing-surface varies leads to a variation of the printing-position off-set between the forward scan and the reverse scan information concerning (affecting) the ink ejection velocity and the recording head moving velocity, such as printing speed, print quality mode, and sort of ink. To cope with this, the present embodiment varies a correction quantity of an ink drop ejection timing in the reverse scan with respect to an ink drop ejection timing in the forward scan by use of information concerning (affecting) the distance from the ink ejection surface of the recording head to the printing surface of the printing medium, such as the medium thickness and the platen gap.

The storage section 25 stores a correction-quantity determining table (i) 401 (corresponding to the tables (1) to (12) in the above instance) as shown in FIG. 6. The correction-quantity determining table (i) 401 contains each of the combinations of the contents that the following information can take (a total of 12 combinations in the above instance), with the parameters being the distance from the ink ejecting surface specified by the medium thickness and the platen gap and the surface of the printing medium: those pieces of information concern printing speed (e.g., 300 cps/200 cps) contained in the control data, which is received from the print controller 1 through the interface section 21, information on the print quality mode (e.g., draft/standard/high resolution), and information on the sorts of ink (e.g., dye/pigment).

The timing correction section 231 calculates a distance (P−T; P: platen gap, T: thickness of the printing medium) from the ink ejecting surface of the recording head to the printing surface of the printing medium by use of 1) information on the medium thickness contained in the control data, which is received through the interface section 21 from the print controller 1 or 2) information on the medium thickness that the operator selects using the instruction receiving section 24 to be described later, and 3 ) a platen gap detected by the platen gap sensor 27. Then, the timing correction section 231 reads out a correction quantity associated with the distance (P−T) from the correction-quantity determining table 401, which contains each of the combinations of information on printing speed actually used for determining the ejection-direction correction quantity d1, information on the print quality mode, and information on the sorts of ink. And it sets the readout correction quantity as a sheet-thickness correction quantity d2.

The reason why the table is provided each of the combinations of the contents that the following information can take information on printing speed, information on the print quality mode, and information on the sorts of ink, follows. A printing-position off-set between the forward scan and the reverse scan, which arises from a variation of the distance from the ink ejecting surface of the recording head to the printing surface of the printing medium, varies with a variation of the ink ejection direction, which is expressed by a composite vector of an ink ejection velocity vector and a moving velocity vector of the recording head.

The correction quantities to be stored in the correction-quantity determining table 401. (FIG. 6) can be obtained empirically. Ink ejection-timing correction quantity to minimize the printing-position off-set between the forward scan and the reverse scan are experimentally obtained at each distance from the ink ejecting surface of the recording head to the medium surface, which is determined by a thickness of a printing medium acceptable in use by the printer 2 and a platen gap adjustable by the platen gap adjusting section 221. The resultant quantities are stored into the correction-quantity determining table 401. The correction-quantity determining table 401 shown in FIG. 6 can be formed by performing the above task for each combination of the contents that the following information can take: information on printing speed, information on the print quality mode, and information on the sorts of ink.

A temperature correction quantity d 3 is determined by temperature of the recording head and ink. The present embodiment compensates for a variation of the ink ejecting velocity (determining an a amount of ink per dot), which arises from a temperature variation of the recording head, while allowing for temperature characteristics of the recording head and ink.

The timing correction section 231 calculates a correction quantity by putting a temperature of the recording head, detected by the temperature sensor 28, into the following correction expression.

| | |
|---|---|
| $Th < Th1$ | $d3 = Th \cdot te1 + tf1$ |
| $Th1 \leqq Th \leqq Th2$ | $d3 = Th \cdot te2 + tf2$ |
| $Th2 < Th$ | $d3 = Th \cdot te3 + ft3$ |

where

Th: temperature of the recording head received from the temperature sensor 28;

Th1 to Th3 temperature values dependent on the temperature characteristics of the recording head and ink, tf1 to tf3: constants determined by the temperature values Th1 to Th3; and te1 to te3 coefficients determined by the temperature values Th1 to Th3.

The values of the constants ft1 to ft3 and the coefficients te1 to te3 are determined by the combinations of printing speed, print quality mode, sort of ink, and distance from the ink ejecting surface of the recording head and the printing surface of the printing medium.

The reasons why the values of the constants tf1 to tf3 and the coefficients te1 to te3 are determined by the combinations of printing speed, print quality mode, sort of ink, and distance from the ink ejecting surface of the recording head and the printing surface of the printing medium, follows. A first reason is that an influence of an ink ejecting velocity variation, caused by the temperature characteristics of the recording head and ink, upon the ink ejecting direction, are dependent on the printing speed, the print quality mode and the sort of ink. A second reason is that this influence on the ink ejecting direction, which is affected to the off-set, also varies depending on the distance from the ink ejecting surface of the recording head to the printing surface of the printing medium.

The values of the constants tf1 to tf3 and the coefficients te1 to te3 may also be determined empirically. A relation of temperature of the recording head (or ink) with an ejection-timing correction quantity to minimize a printing-position off-set between the forward scan and the reverse scan is obtained by experiment, and the constants and the coefficients are calculated by use of the resultant relation. The values of the constants tf1 to tf3 and the coefficients te1 to te3 are obtained by performing the above task for each combination of the printing speed, the print quality mode, the sort of ink, and the distance from the ink ejecting surface of the recording head to the printing surface of the printing medium.

The correction-quantity determining table (i) 501 (corresponding to the tables (1) to (12)) as shown in FIG. 7 may be stored in the storage section 25; instead of calculating the temperature correction quantity d3 by use of the correction expression. The correction-quantity determining table (i) 501 contains each of the combinations of the contents that the following information can take (a total of 12 combinations in the above instance), with the parameters being the distance from the ink ejecting surface specified by the medium thickness and the platen gap and the surface of the printing medium: those pieces of information concern printing speed (e.g., 300 cps/200 cps), information on the print quality mode (e.g., draft/standard/high resolution), and information on the sorts of ink (e.g., dye/pigment).

The timing correction section 231 reads out a correction quantity associated with the distance from the ink ejection surface to the medium surface and an ink temperature, from the correction-quantity determining table which contains each of the combinations of information on printing speed actually used for determining the ejection-direction correction quantity d1, information on the print quality mode, and information on the sorts of ink calculates a distance (P−T; P: platen gap, T: thickness of the printing medium) from the ink ejecting surface of the recording head to the printing surface of the printing medium by use of 1) information on the medium thickness contained in the control data, which is received through the interface section 21 from the print controller 1 or 2) information on the medium thickness that operator selects using the instruction receiving section 24 to be described later, and 3) a platen gap detected by the platen gap sensor 27. Then, the timing correction section 231 reads out a correction quantity associated with the distance (P−T) from the correction-quantity determining table 401. The table contains each of the combinations of information on printing speed actually used for determining the ejection-direction correction quantity d1, information on the print quality mode, and information on the sorts of ink. And it sets the readout correction quantity as a temperature correction quantity d3.

The ejection-direction correction quantity d1 and sheet-thickness correction quantity d2 are calculated by use of the control data, which comes from the print controller 1 before the printing operation starts. It never happens that the values of those quantities are changed during the printing operation. However, the temperature correction quantity d3 is calculated by use of a head temperature sensed by the temperature sensor 27 every time the home position sensor 29 senses that the recording head reaches the home position. Therefore, the ejection-timing correction quantity D is calculated every time the recording head reaches the home position, viz., the recording head 1 moves forward and returns to the home position.

When the instruction receiving section 24 receives a test pattern print instruction, the test-pattern-print controller section 232 controls the printer engine section 22 so that it prints a test pattern, which is used for detecting a thickness of a printing medium set in the printer 2, on the same printing medium in the bi-directional printing mode in a state that the printing speed, the print quality mode, and the platen gap are put in predetermined conditions (default values).

Figure 8:
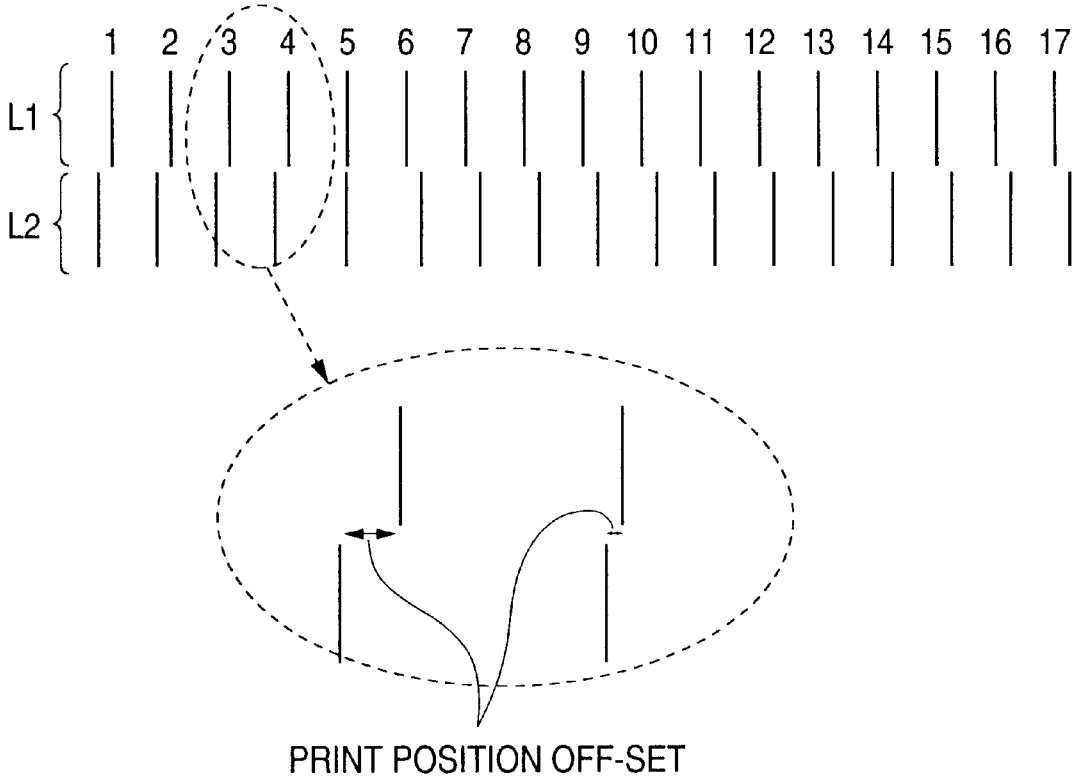
FIG. 8 is a diagram showing a test pattern for detecting a thickness of a printing medium.

FIG. 8 shows a diagram showing an example of a printing medium with a test pattern printed thereon, which is used for a thickness of a printing medium.

As shown, the test pattern consists of two patterns of vertical short bars serially and horizontally arrayed; an upper sub-pattern L1 printed by the forward scan and a lower sub-pattern L2 printed by the reverse scan. Ink ejection timings in both the forward and reverse scans are adjusted so that when those upper and lower sub-patterns are printed on a printing medium of a predetermined thickness, the printing positions in the forward scan are respectively coincident with those in the reverse scan, and the vertical short bars of the upper sub-pattern are respectively aligned with those of the lower sub-pattern to form one pattern of vertical long bars arranged side by side. In other words, one can know a thickness of a printing medium by finding a printed test pattern in which the vertical short bars of the upper sub-pattern are respectively aligned with those of the lower sub-pattern to form one pattern of vertical long bars serially and horizontally arrayed. In FIG. 8, numbers attached to above the vertical short bars of the upper this case, the operator uses the instruction receiving section 24 for registering the print result.

The instruction receiving section 24 includes an operation panel (not shown), which is provided in the printer body. It receives a test pattern print instruction, an instruction for registering a test pattern print results or an instruction to select one of the test pattern print results, which were registered by the registering instruction. Those instructions are entered by the operator.

The storage section 25 stores a table storing the correspondence between identification information (numbers) of vertical bars of the test pattern and information on a thickness of a printing medium when each pair of the corresponding vertical short bars of the upper and lower sub-patterns are aligned with each other to form one long vertical bar. The identification information (numbers) of vertical bars of the test pattern, specified by the operator, and the register names (e.g., names of the printing media) are correspondingly stored in accordance with a registering instruction of the test pattern print result.

An operation of the printing system thus constructed will be described.

An operation to register the print result of the test pattern into the printer 2 will be described.

Figure 9:
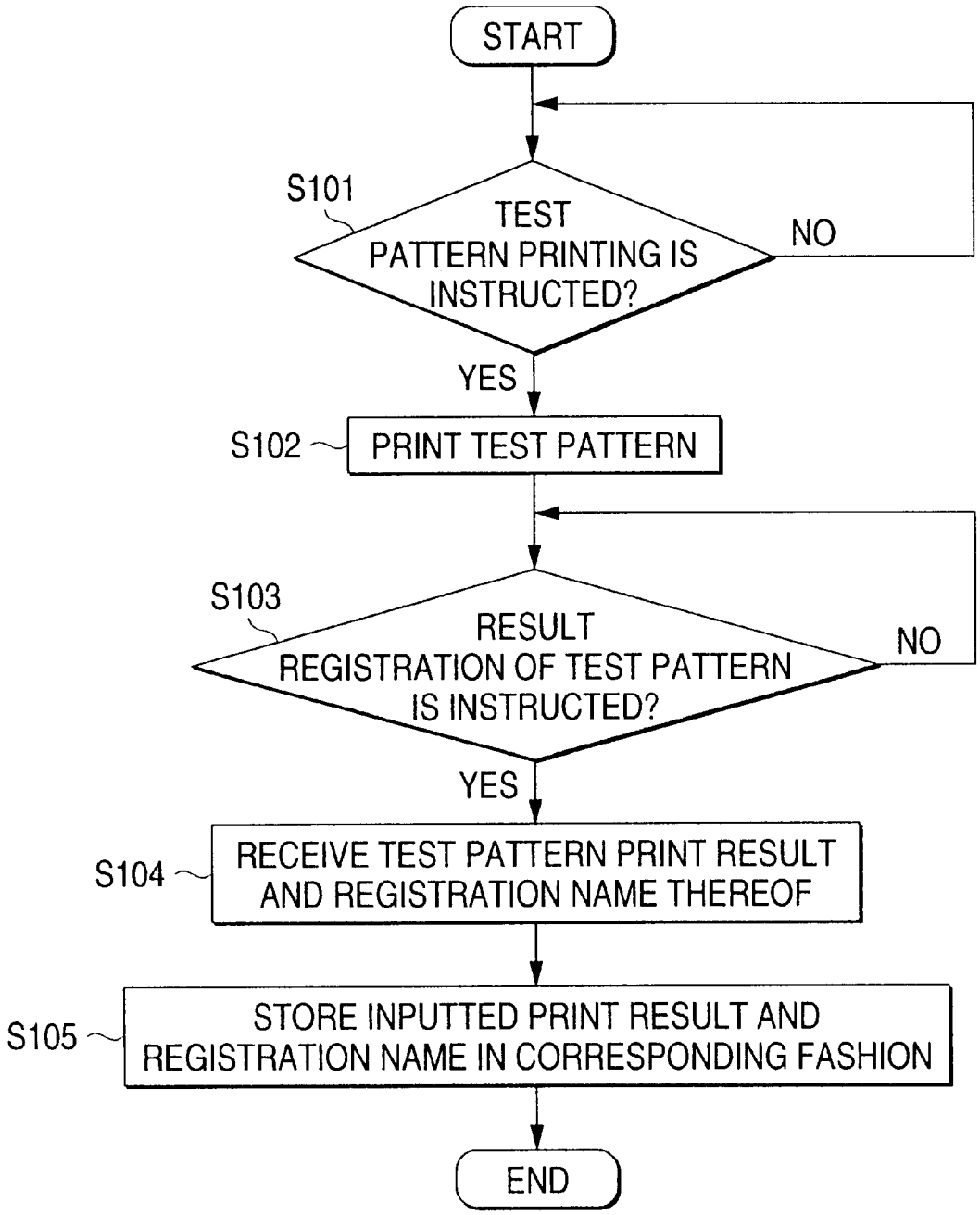
FIG. 9 is a flow chart for explaining an operation of the printing system when the operator registers the test-pattern print result to the printer 2.

FIG. 9 is a flow chart showing an operation of the printing system when the operator registers the test pattern print result into the printer 2.

The operator sets a desired printing medium to the printer 2, and enters an instruction to start printing of a test pattern by use of the operation panel (step S101). The instruction receiving section 24 receives the instruction and informs the test-pattern-print controller section 232 of the reception of the instruction. Upon receipt of it, the test-pattern-print controller section 232 controls the printer engine section 22 so as to print a test pattern, which is for detecting a thickness of the printing medium, on the printing medium already set in a bi-directional printing mode in the predetermined conditions (at the default values) about the ink ejection velocity, the head moving velocity, the sort of ink, and the platen position. As a result, a test pattern as shown in FIG. 8 is printed on the set printing medium (step S102).

Then, the operator enters an instruction to register a test pattern print result on the operation panel (step S103); the instruction receiving section 24 receives the entered instruction; and receives the number assigned to one pair of vertical short bars of the test pattern as shown in FIG. 8 and a register name of that number (e.g., a name of the printing medium on which a test pattern is printed) (step S104). Thereafter, the storage section 25 stores the number of the input vertical line and the register name in a corresponding fashion (step S105).

An operation of the printing system when the operator selects thickness information of the printing medium on the operation panel of the printer 2, will be described.

Figure 10:
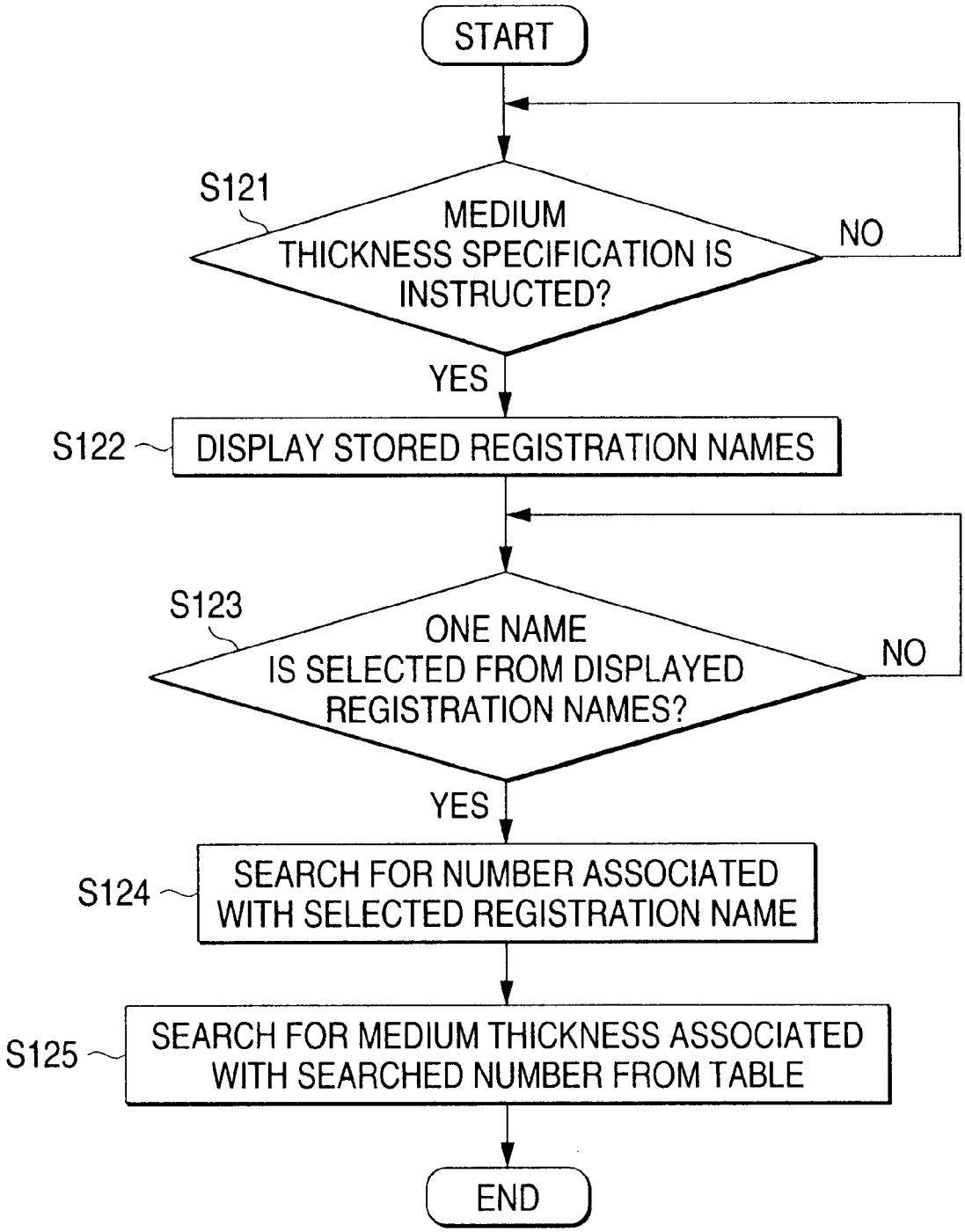
FIG. 10 is a flow chart for explaining an operation of the printing system when the operator selects medium thickness information on the operation panel of the printer 2.

FIG. 10 is a flow chart showing an operation of the printing system when the operator selects thickness information of the printing medium on the operation panel of the printer 2.

When the instruction receiving section 24 of the printer 2 receives an instruction to designate the thickness information of the printing medium (step S121), a list of the register names, which are stored in the storage section 25 in accordance with the test-pattern print result registering process (FIG. 9), are displayed on the screen of the liquid crystal display device, for example, of the operation panel (step S122). It instructs the operator to select one of the register names (which are stored in the storage section 25).

When the operator selects the register name on the operation panel (step S123), the instruction receiving section 24 searches for the number of the vertical line number associated with the selected register name in the storage section 25 (step S124). Then, the thickness information of the printing medium associated with the searched vertical line number is read out of the table containing the correspondence of the vertical line numbers and the thickness information of the printing media, which is stored in the storage section 25, the readout thickness information is sent as the medium thickness information selected by the operator to the timing correction section 231 of the controller section 23 (step S125).

An operation of the printer 2 when print data is printed on the printing medium which is set to the printer, will be described.

Figure 11:
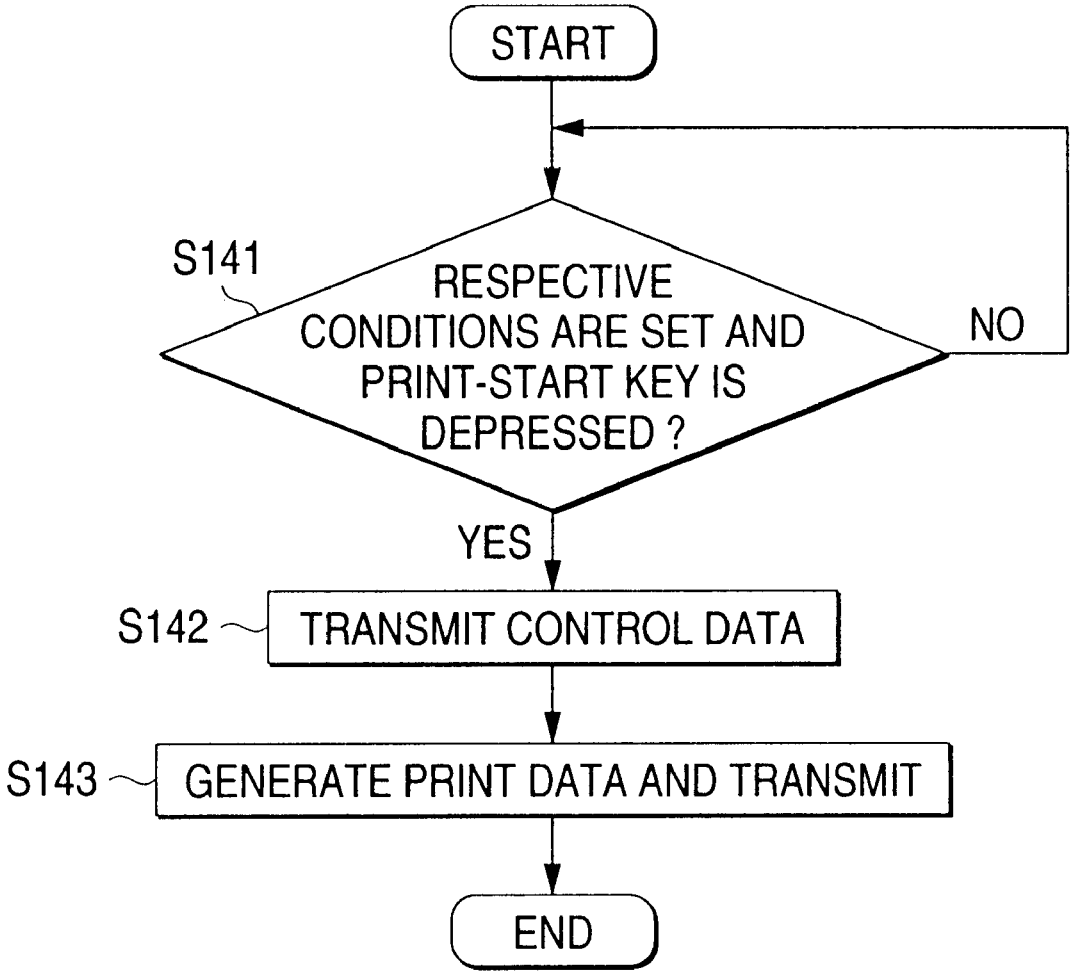
FIG. 11 is a flow chart for explaining an operation of the print controller 1 when print data is printed on a printing medium in the first embodiment.

FIG. 11 is a flow chart showing an operation of the print controller 1 in the present embodiment when print data is printed on the printing medium.

To execute the process or printing program flow-charted in FIG. 11, an application software, such as a word processing software or a graphic software, in the information processor functioning as the print controller 1 issues a print start instruction; a print control program, which is stored in the external storage device 103 or the information recording medium 108, is in turn loaded into the memory 102; and the CPU 101 executes the program.

In the print controller 1, the instruction receiving section 11 displays a select screen as shown in FIG. 3. The select screen contains several options, such as the size and sort of the printing media, print quality modes, and printing speed. The print controller 1 waits till the operator selects those pieces of information and presses the print start key (step S141).

Upon depressing the print start key, the instruction receiving section 11 outputs the conditions of each option selected on the select screen to the printer controller section 12. Upon receipt of the conditions, the instruction receiving section 11 reads out the thickness information associated with the sort of the printing medium received by the instruction receiving section 11, from the table (not shown) containing the correspondence between the sorts of the printing media and the thickness information of the printing media, which the table is stored in the external storage device 103. Then, the readout thickness information of the printing medium is transferred to the interface section 13, together with the information of the medium size and the print quality mode, which are received by the instruction receiving section 11. In turn; the interface section 13 transfers those pieces of information as the control information for print data to the printer 2 (step S142).

The printer controller section 12 generates print data containing text and image of which the printing is instructed by a proper application software (e.g., word processing or graphic software), and the print data is transmitted to the printer 2, through the interface section 13 (step S143).

Figure 12:
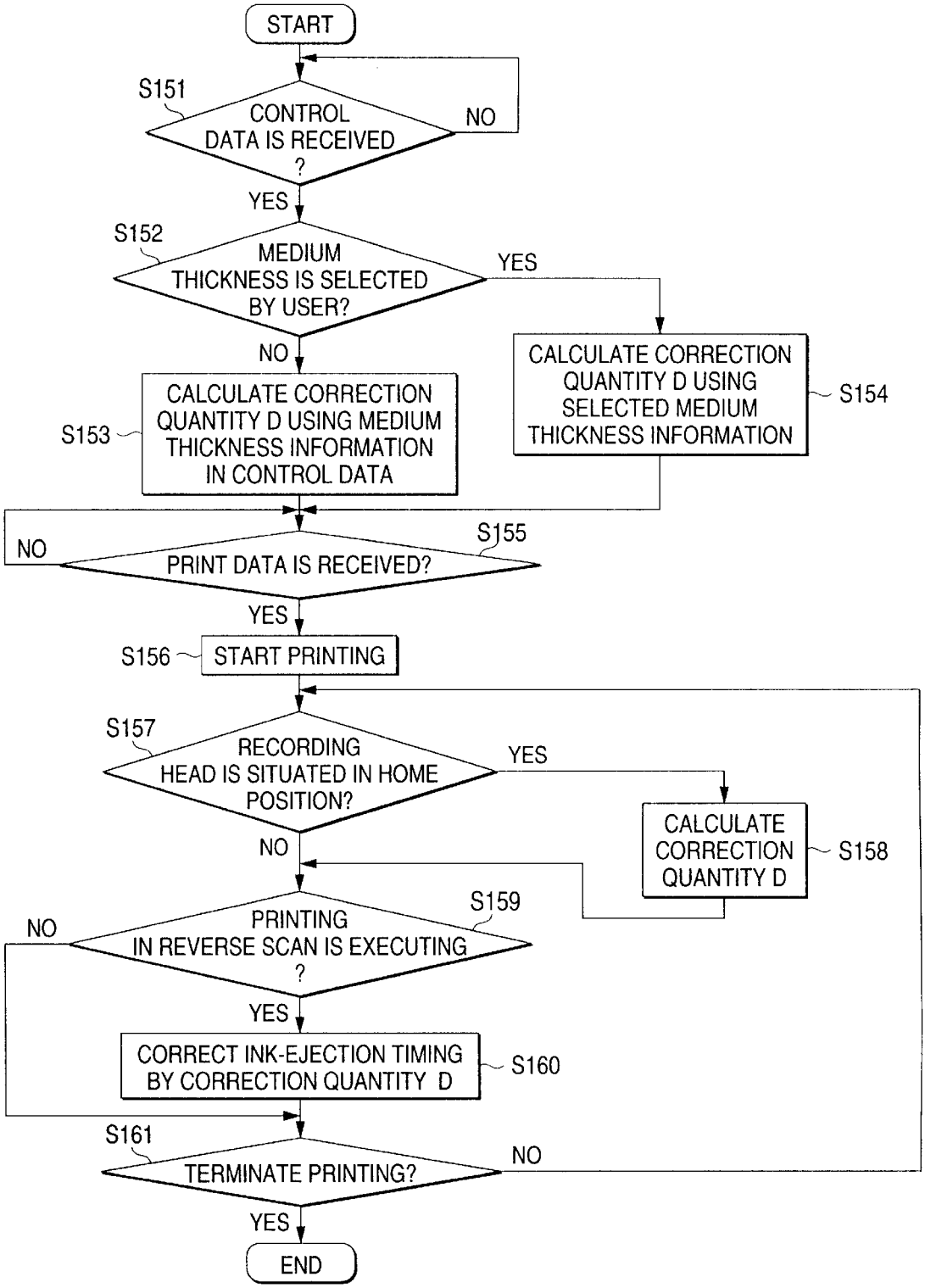
FIG. 12 is a flow chart for explaining an operation of the printer 2 when print data is printed on a printing medium in the first embodiment.

FIG. 12 is a flow chart for explaining an operation of the printer 2 when the print data is printed on the printing medium.

When the printer 2 receives the control data through the interface section 21 (transmission of the control information to the apparatus 2 was performed by the information transmission process of FIG. 11) (step S151), the timing correction section 231 of the controller section 23 judges as to whether or not the operator selects the medium thickness information on the operation panel of the printer 2, viz., the medium thickness information has been selected by the process flow-charted in FIG. 10 (step S152).

When the medium thickness information is not selected by the FIG. 10 process flow, the timing correction section 231 uses the medium thickness information contained in the control data received from the print controller 1 as the medium thickness information, and calculates a correction quantity D of an ink drop ejection timing in the reverse scan with respect to that in the forward scan (step S153) by use of the correction quantity calculating formula (D=an off-set quantity of an ink ejecting position in the reverse scan with respect to that in the forward scan).

When the medium thickness information is selected by the FIG. 10 process flow, the timing correction section 231 uses the selected medium thickness information as the medium thickness information, and calculates a correction quantity D of an ink drop ejection timing in the reverse scan with respect to that in the forward scan (step S153) by use of the correction quantity calculating formula (step S154).

The controller section 23 controls the printer engine section 22 so that it prints the print data on the printing medium in the bi-directional printing mode in the printing conditions specified by the information of the medium size, print quality mode, and printing speed, which come from the print controller 1, and in the printing conditions specified by the information of the sort of ink and the platen position, which are sensed by the various sensors of the printer 2. And printing of the print data on the printing medium starts (step S156).

During the printing of the print data on the printing medium, the controller section 23 monitors a signal from the home position sensor 29 and detects if the recording head reaches the home position (strap S157). When the recording head reaches the home position, a temperature correction quantity d3 is calculated by use of a head temperature measured by the thermal sensor 28, and an ejection-timing correction quantity D is calculated anew by use of the calculated temperature correction quantity d3 (step S158). Accordingly, the ejection-timing correction quantity D is calculated by use of an updated head temperature every time the recording head returns to the home position during the printing of the print data on the printing medium.

During the printing of the print data on the printing medium, the controller section 23 monitors a moving direction of the recording head and judges if the current printing operation is performed through the reverse scan (step S159). When the current printing operation is performed through the reverse scan, the printer engine section 22 off-sets an ink ejecting timing of the recording head (ink ejecting position) with respect to an ink ejecting timing (ink ejecting position) of the recording head when the recording head engages in the printing by the reverse scan by an updated correction quantity D calculated by the timing correction section 231 (step S160).

The execution of the steps S157 to S160 is continued till the printing of the print data on the printing medium ends (step S161).

As described above, in the first embodiment, before transmitting print data, the print controller 1 sends information on a thickness of a printing medium associated with a sort of a printing medium selected by a printer operator or user, together with control data for the print data, to the printer 2. In the printer 2, the timing correction section 231 corrects a timing of ejecting an ink drop onto a printing medium for printing print data on the printing medium in accordance with the control data including information on a thickness of a printing medium.

Therefore, the operator can correct a printing-position off-set between the forward scan and the reverse scan, which will occur when the printer prints print data on a variety of printing media in the bi-directional printing mode, by merely designating information on a thickness of a printing medium, which is to be transmitted to the printer. Accordingly, stress imposed on the operator is lessened.

In the first embodiment, the timing correction section 231 of the printer 2 calculates an ejection-timing correction quantity D by use of an updated head temperature measured by the thermal sensor 28 every time the recording head returns to the home position. This technical feature prevents a printing-position off-set arising from a temperature variation of the recording head during the printing operation.

In the embodiment, the printer 2 includes the test-pattern-print controller section 232 for printing a test pattern to detect a thickness of a printing medium, and the storage section 25 for storing a table containing the correspondence between the test pattern print result and the medium thickness information. When the instruction receiving section 24 receives an instruction to register the test pattern print result from a printer operator, the received test pattern print result, together with the register name, is stored into the storage section 25. When the register name is selected through the instruction receiving section 24, it searches for the test pattern print result associated with the selected register name in the storage section 25, and looks up medium thickness information associated with the searched test pattern print result in the table stored in the storage section 25. The timing correction section 231 corrects a timing of ejecting an ink drop on the printing medium by use of the medium thickness information read out of the table, in place of the medium thickness information contained in the control data.

In this way, even when the printer prints on a printing medium which has been not yet recognized by the print controller 1, a printing-position off-set between the forward scan and the reverse scan can be corrected.

In the first embodiment, the control data to be transmitted from the print controller 1 to the printer 2 contains the information on the print quality mode and the printing speed in addition to the medium thickness information. In a case where the values of the print quality mode and the printing speed are set at fixed values or those may be measured in the printer 2, there is no need of transmitting those pieces of information in a state that those are contained in the control data. In this case, the values of the print quality mode and the printing speed used by the timing correction section 231 of the printer 2 for calculating an ejection-timing correction quantity D between the forward scan and the reverse scan are predetermined fixed values or the values entered on the operation board.

In the first embodiment, the medium thickness information is acquired from the control data received from the print controller 1 or from the operator through the operation panel of the printer 2. Alternatively, a medium thick sensor (e.g., a photo sensor) for detecting a thickness of a printing medium set on the platen may be provided for the same purpose. In this case, the medium thickness information is acquired from a signal output from the sensor.

In the first embodiment, the timing correction section 231 of the printer 2 calculates an ejection-timing correction quantity D by use of a head temperature which is updated or sensed by the thermal sensor 28 every time the recording head returns to the home position. In an alternative, a head temperature may be measured in real time, and the measured one is used for calculating the ejection-timing correction quantity D. In another alternative, the ejection-timing correction quantity D is calculated by use of a head temperature measured before the start of printing, and is used for correcting an ink ejection timing during a printing operation.

The select screen shown in FIG. 3 is a typical example. Further, the test pattern shown in FIG. 8 is also a typical example, and it may be substituted by any other pattern if it is able to detect the medium thickness.

A second embodiment of the present invention will be described.

Figure 13:
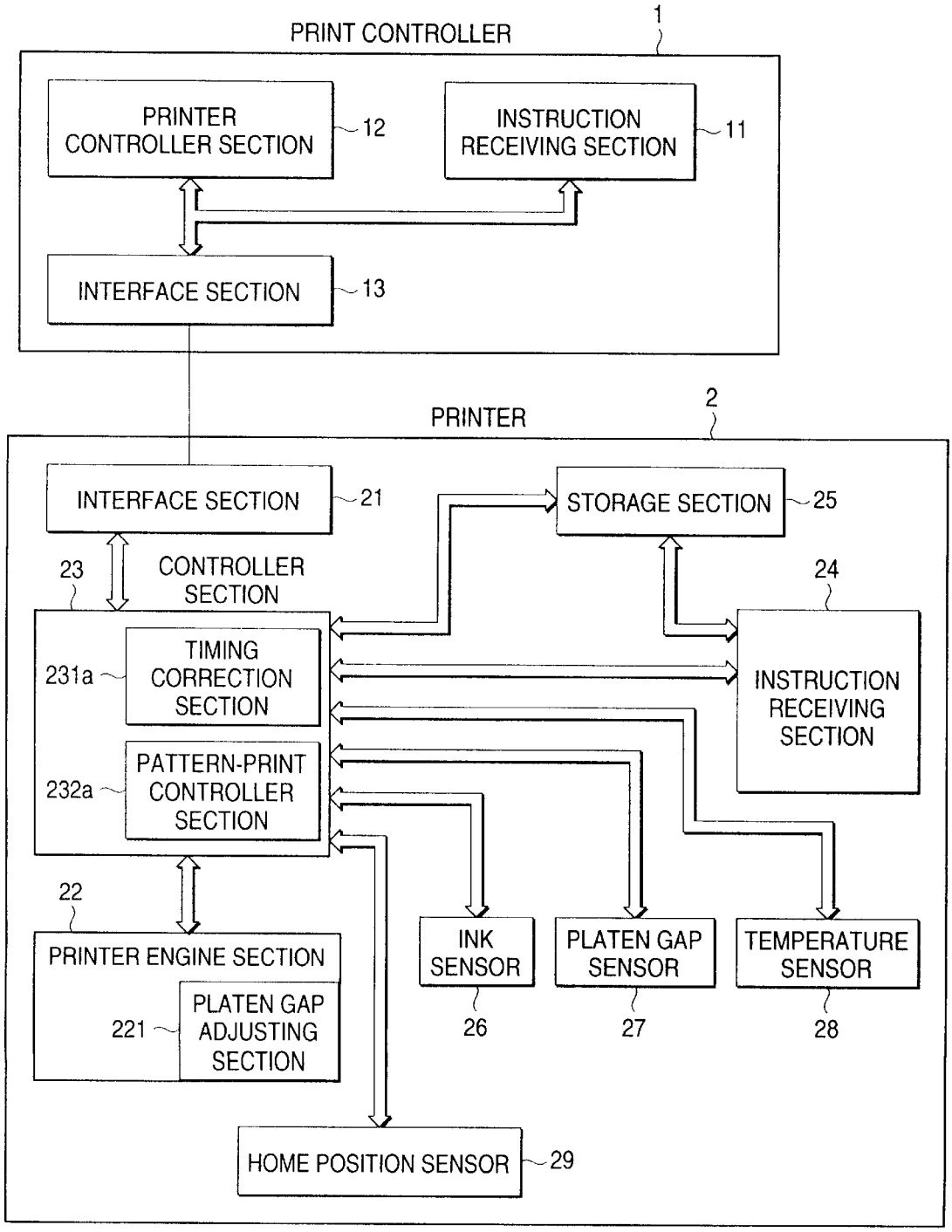
FIG. 13 is a block diagram showing a printing system according to a second embodiment of the present invention.

FIG. 13 is a block diagram showing a printing system which is the second embodiment of the invention.

The printing system of FIG. 13 is different from the FIG. 1 printing system in that the controller section 23 of the printer 2 uses a timing correction section 231*a* and a test-pattern-print control section 232*a* in place of the timing correction section 231 and the test-pattern-print controller section 232. The remaining construction of the FIG. 13 printing system is substantially the same as of the FIG. 1 one. Therefore, like reference numerals used in FIG. 1 are attached to the components in the remaining construction shown in FIG. 13, and description of them will be omitted.

The timing correction section 231*a* constructs a mathematical expression of a distance H from the ink ejecting surface of the recording head to the printing surface, which is determined by a thickness of a printing medium and a platen gap, and an ejection-timing correction quantity D between the forward scan and the reverse scan for each combination of the information on printing speed (e.g., 300 cps/200 cps), information on the print quality mode (e.g., draft/standard/high resolution), and information on the sorts of ink (e.g., dye/pigment). The mathematical expression thus constructed is stored in the storage section 25 in a state that it is arranged in association with the print quality mode, the printing speed and the sort of ink.

Figure 14:
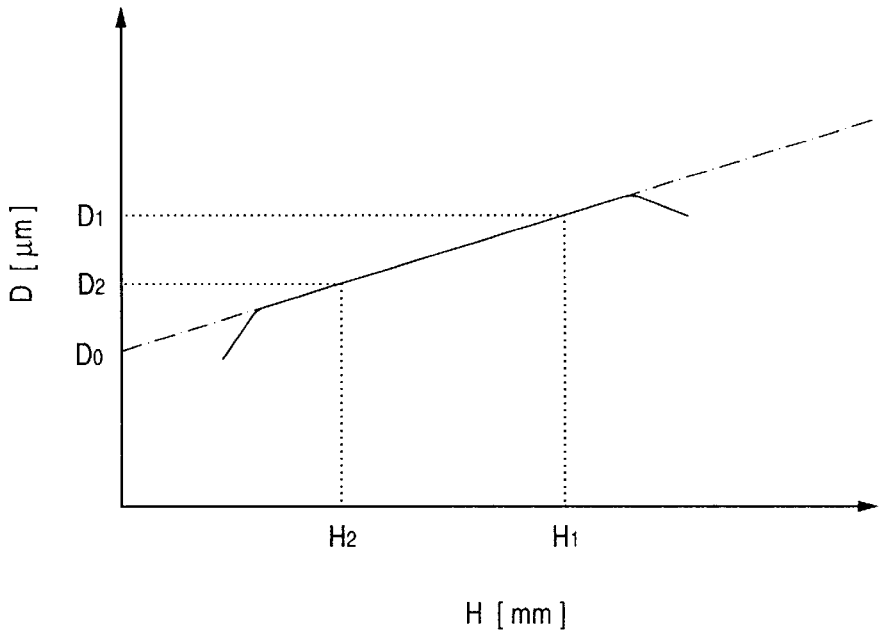
FIG. 14 is a graph showing a variation of an ejection-timing correction quantity D with respect to a distance H from the ink ejection surface of the recording head to the printing surface of the recording head.

The present inventors found the following fact: an ejection-timing correction quantity D linearly varies with respect to the distance H from the ink ejecting surface of the recording head to the printing surface as shown in FIG. 14. The mathematical expression is given by $$D = \frac{D_1 - D_2}{H_1 - H_2} H + \frac{D_1 H_2 - D_2 H_1}{H_2 - H_1}$$

where $D_1$: ejection-timing correction quantity when $H=H_1$ $D_2$: ejection-timing correction quantity when $H=H_2$.

In the present embodiment, to operate the above expression, the ejection-timing correction quantities $D_1$ and $D_2$ each between the forward scan and the reverse scan are calculated when the recording head prints on a printing medium (reference sheet) of a predetermined thickness $T_1$ at each of two platen gaps $P_1$ and $P_2$, which are set by the platen gap adjusting section 221. (The ejection-timing correction quantities $D_1$ and $D_2$ are each an off-set of an ink ejecting position in the reverse scan with respect to that in the forward scan, shown in FIG. 19B) In this case, the distance H from the ink ejecting surface of the recording head to the printing surface is equal to the result of subtracting a thickness T of a printing medium from a platen gap P. Therefore, the above expression can be rewritten into $$\begin{aligned} D &= \frac{D_1 - D_2}{(P_1 - T_1) - (P_2 - T_1)}(P - T) + \frac{D_1(P_2 - T_1) - D_2(P_1 - T_1)}{(P_2 - T_1) - (P_1 - T_1)} \quad (1) \\ &= \frac{D_1 - D_2}{P_1 - P_2}(P - T) + \frac{D_1(P_2 - T_1) - D_2(P_1 - T_1)}{P_2 - P_1} \end{aligned}$$

The expression (1) is approximately expressed as $$D = \frac{D_1 - D_2}{P_1 - P_2}(P - T - T_1) + \frac{D_1 P_2 - D_2 P_1}{P_2 - P_1} \quad (2)$$

The reason why the mathematical expression is constructed for each combination of the print quality mode, printing speed and the sort of ink follows. As described above, an ink ejecting direction is expressed by a composite vector of an ink ejecting velocity vector and a moving velocity of the recording head. Accordingly, when the moving velocity of the recording head or the ink ejecting velocity vary, the ink ejecting direction also varies and hence a printing-speed off-set between the forward scan and the reverse scan also varies. For this reason, in the embodiment, the mathematical expression is calculated for each combination of the printing speed, the print quality mode and the sort of ink, which concern (affect) the ink ejecting velocity and the moving velocity of the recording head, and the resultant one is stored in the storing section 25.

Where the distance H from the ink ejecting surface of the recording head to the printing surface is too short or long, the linear relationship between H and D is lost as seen from FIG. 14. To avoid this, the thickness $T_1$ of the printing medium (reference printing medium) on which a test pattern is to be printed and the platen gaps $P_1$ and $P_2$ must be set so that the mathematical expression holds viz., the relationship between H and D is linear.

Then, the timing correction section 231*a* reads out the expression from the storage section 25 (the mathematical expression stored therein respectively corresponding to each combination of the information on printing speed (e.g., 300 cps/200 cps), information on the print quality mode (e.g., draft/standard/high resolution), and information on the sorts of ink (e.g., dye/pigment), which are contained in the control data received from the printer 1, through the interface section 21; puts the medium thickness T specified by the thickness information contained in the control data into the mathematical expression to calculate the printing-position off-set between the forward scan and the reverse scan; and corrects an ink ejecting timing (ink ejecting position) in the reverse scan with respect to that in the forward scan.

When the instruction receiving section 24 receives a test pattern print instruction, the test-pattern-print control section 232*a* controls the printer engine section 22 so that it prints a test pattern (which is for detecting a correction quantity value of an ink ejecting timing (ink ejecting position) in the reverse scan with respect to that in the forward scan) on the printing medium (reference printing medium) of the thickness $T_1$ in the conditions of the printing speed and the print quality mode designated by the test pattern print instruction received. This process is carried out for each of the platen gaps $P_1$ and $P_2$ by controlling the platen gap adjusting section 23 and adjusting a position of the recording head.

Figure 15:
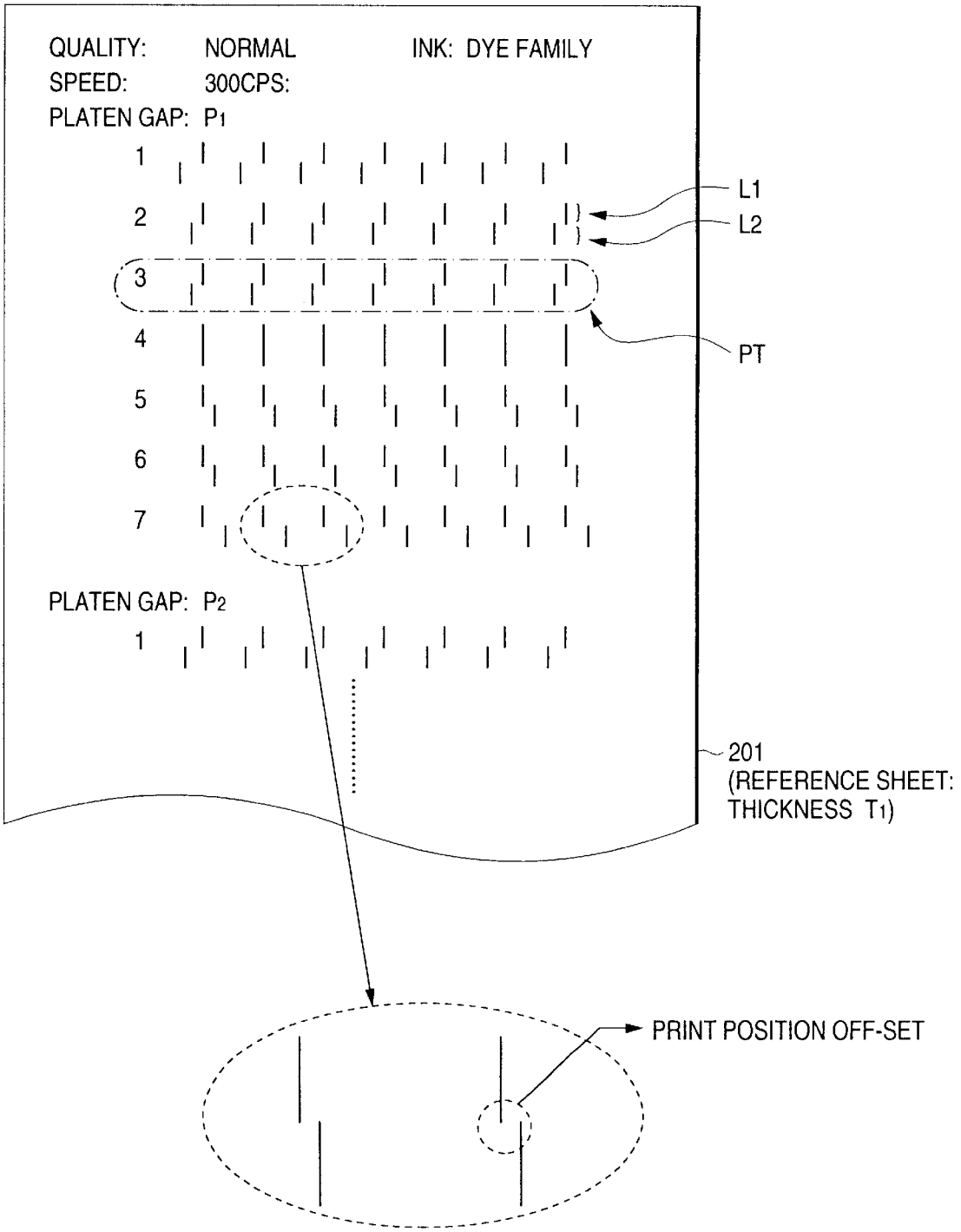
FIG. 15 is a diagram showing test patterns printed on a printing medium (reference sheet) for detecting an ejection-timing correction quantity D in the reverse scan with respect to that in the forward scan.

FIG. 15 is a diagram showing an example of a printing medium (reference printing medium) having test patterns printed thereon for detecting a correction quantity of an ink ejection timing in the reverse scan with respect to that in the forward scan.

As shown, the conditions of printing speed and a print quality mode designated by a test pattern print instruction, and a sort of ink detected by the ink sensor 26 are printed on the reference printing medium, and test patterns are printed for detecting a correction quantity for an ink (drop) ejecting timing in the reverse scan with respect to that in the forward scan by the recording head. The test patterns are grouped for each of platen gaps $P_1$ and $P_2$, and each group of test patterns are numbered 1 to 7. Those numbers are used when the operator registers the test-pattern print results by means of the instruction receiving section 24 to be described later. Each test pattern PT consists of upper and lower sub-patterns each consisting of vertical short bars arranged horizontally and serially. The upper sub-pattern L1 is printed by the forward scan, while the lower sub-pattern L2 is printed by the reverse scan.

The test patterns are each printed in a state that an ink ejection timing in the reverse scan is adjusted with respect to that in the forward timing by use of an ink ejection-timing correction quantity (quantities). Therefore, one can know a proper ejection-timing correction quantity by finding a test pattern in which the paired vertical short bars of the upper and lower sub-patterns are vertically aligned with each other to form corresponding vertical long bars or an off-set of each pair of vertical short bars of the upper and lower sub-patterns is minimized. In the test pattern group of the platen gap $P_1$ in FIG. 15, the ink ejection-timing correction quantity used for printing the test pattern numbered 4 is a proper one.

The instruction receiving section 24 includes an operation panel (not shown), which is installed to the printer 2. The operator enters a test pattern print instruction or an instruction of registering a test-pattern print-result on the operation panel. In other words, the instruction receiving section 24 receives those instructions thus entered from the operation panel.

The storage section 25 stores a table in which the numbers of the test patterns (FIG. 15) and the ejection-timing correction quantities used for printing the numbered test patterns are tabulated in corresponding fashion. Further, it stores the mathematical expression used for calculating the ejection-timing correction quantities calculated by the timing correction section 231*a* in connection with the print quality mode, the printing speed and the sort of ink.

An operation of the printing system thus constructed will be described:

An operation to derive a mathematical expression describing a relation of a thickness of a printing medium and an ejection-timing correction quantity.

Figure 16:
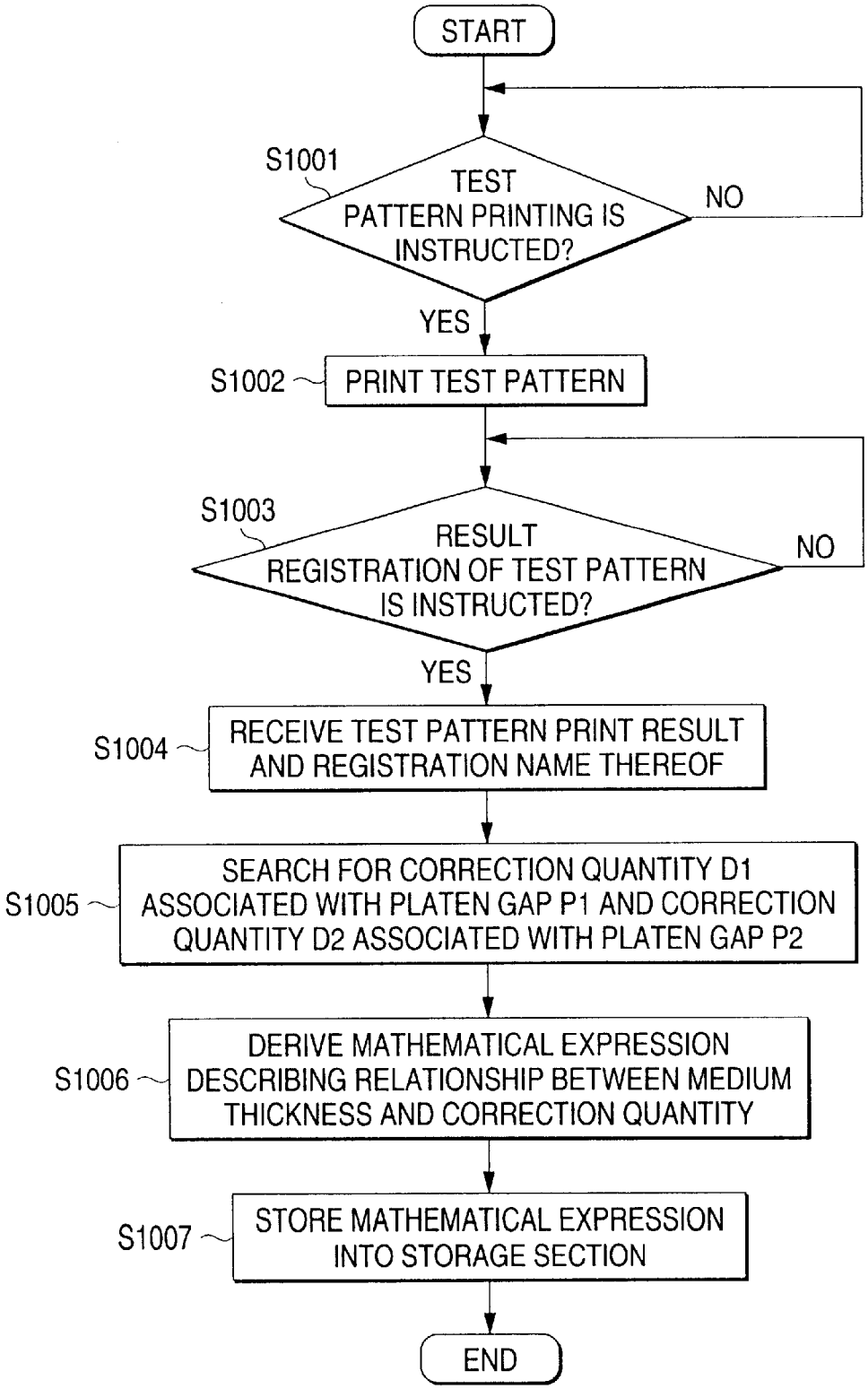
FIG. 16 is a flow chart for explaining an operation of the printing system when a formula describing a relation between the medium thickness and an ejection-timing correction quantity is derived.

FIG. 16 is a flow chart showing an operation of the printing system when the mathematical expression describing a relation between the medium thickness and the ejection-timing correction quantity is derived.

An operator sets a printing medium (reference printing medium) having a thickness $T_1$ to the printer 2; designates a print quality mode and a printing speed on the operation panel; and enters an instruction of a test pattern print start (S1001). In turn, the instruction receiving section 24 receives those instructions, and informs the pattern-print control section 232*a* of the controller section 23 of the reception of the instructions. Upon receipt of this, the pattern-print control section 232*a* sets the platen gap $P_1$ by the platen gap adjusting section 221, and controls the printer engine section 22 so that it prints a test pattern in a bi-directional printing mode on the reference medium by the recording head at the print quality mode and the printing speed, which were set by the operator. In this case, the test pattern is for detecting an ejection-timing correction quantity in the reverse scan with respect to that in the forward scan. Then, the pattern-print control section 232*a* sets the platen gap $P_2$ by the platen gap adjusting section 221, and controls the printer engine section 22 so that it prints a test pattern in a bi-directional printing mode on the reference medium by the recording head at the print quality mode and the printing speed, which were set by the operator. Also in this case, the test pattern is for detecting an ejection-timing correction quantity in the reverse scan with respect to that in the forward scan. The result of the printing is as shown in FIG. 15 (step S1002).

Then, the operator enters an instruction to register the print result of the test pattern on the operation panel (step S1003). The instruction receiving section 24 receives the instruction, and receives from the operation panel the print quality mode, the printing speed and the sort of ink at which the test pattern was printed, and the numbers of the test patterns showing the best results at the platen gaps $P_1$ and $P_2$ from among plural test patterns (FIG. 15) (step S1004). (As already described, the test pattern having the best print result is such that the vertical short bars of the upper sub-pattern of the test pattern are aligned with those of the lower sub-pattern to form continuous vertical long bars.) Thereafter, the instruction receiving section 24 looks up the ejection-timing correction quantity $D_1$ corresponding to the number of the test pattern having the best print result at the platen gap $P_1$ and the ejection-timing correction quantity $D_2$ corresponding to the number of the test pattern having the best print result at the platen gap $P_2$ in the table (stored in the storage section 25) in which the pattern numbers and the ejection timing correction values used for the test pattern printing are correspondingly tabulated (step S1005). Thereafter, the instruction receiving section 24 transfers to the controller section 23 the ejection-timing correction quantities $D_1$ and $D_2$, together with the print quality mode, the printing speed and the sort of ink, which were received in the step S1004.

The pattern-print control section 232*a* of the controller section 23 puts the ejection-timing correction quantity $D_1$ at the platen gap $P_1$ and the ejection-timing correction quantity $D_2$ at the platen gap $P_2$, which are received from the instruction receiving section 24 into the mathematical expression (1) or (2), whereby a mathematical expression of the medium thickness T with the ejection-timing correction quantity D is derived (step S1006). The resultant mathematical expression is stored into the storage section 25 while corresponding to the print quality mode, the printing speed and the sort of ink, which are received from the instruction receiving section 24 (step S1007).

The above process is carried out for all the combinations of the print quality mode, the printing speed and the sort of ink, which can be accepted by the printer 2. As a result, the mathematical expressions of the medium thickness T with the ejection-timing correction quantity D are obtained for all the combinations of the print quality mode, the printing speed and the sort of ink. The expressions are stored into the storage section 25.

An operation of the printing system when print data is printed on the printing medium set to the printer 2 in a bi-directional printing mode will be described.

Figure 17:
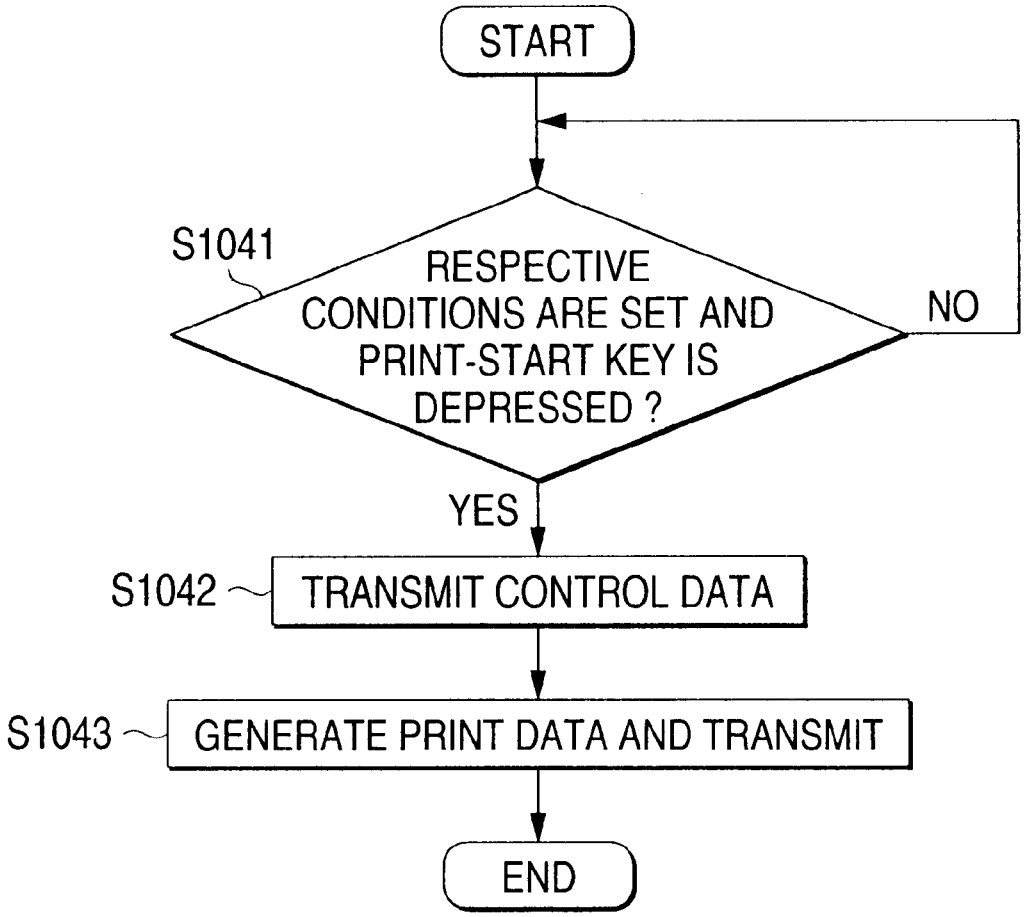
FIG. 17 is a flow chart for explaining an operation of the print controller 1 when print data is printed on a printing medium in the second embodiment.

FIG. 17 is a flow chart for explaining an operation of the print controller 1 in the printing system when print data is printed on the printing medium.

To executed the printing process or program flow-charted, an application software (e.g., word processing or graphic software) issues a printing instruction in the information processor as the print controller 1; a print control program, stored in the external storage device 103 or the information recording medium 108, is in turn loaded into the memory 102; and the CPU 101 executes the program.

The instruction receiving section 11 in the print controller 1 displays a select screen containing options of the size and sort of a printing medium, print quality mode and printing speed (FIG. 3). And it waits till an operator selects those pieces of information and presses the print start key (step S1041).

Upon pressing of the print start key, the instruction receiving section 11 transfers the conditions of the options selected on the operation panel to the printer controller section 12. Upon receipt of this, the printer controller section 12 reads out the medium thickness information associated with the sort of the printing medium (received by the instruction receiving section 11) from the table containing the sorts and thickness values of printing media in corresponding manner, and transfers the readout information to the interface section 13. In this case, the information of the medium size, print quality mode, and printing speed are also transferred to the interface section 13. Then, the interface section 13 transfers those pieces of information as control data for print data to the printer 2 (step S1042).

Then, the printer controller section 12 generates print data containing text and image, instructed by a proper application software (e.g., word processing or graphic software) (step S1043).

Figure 18:
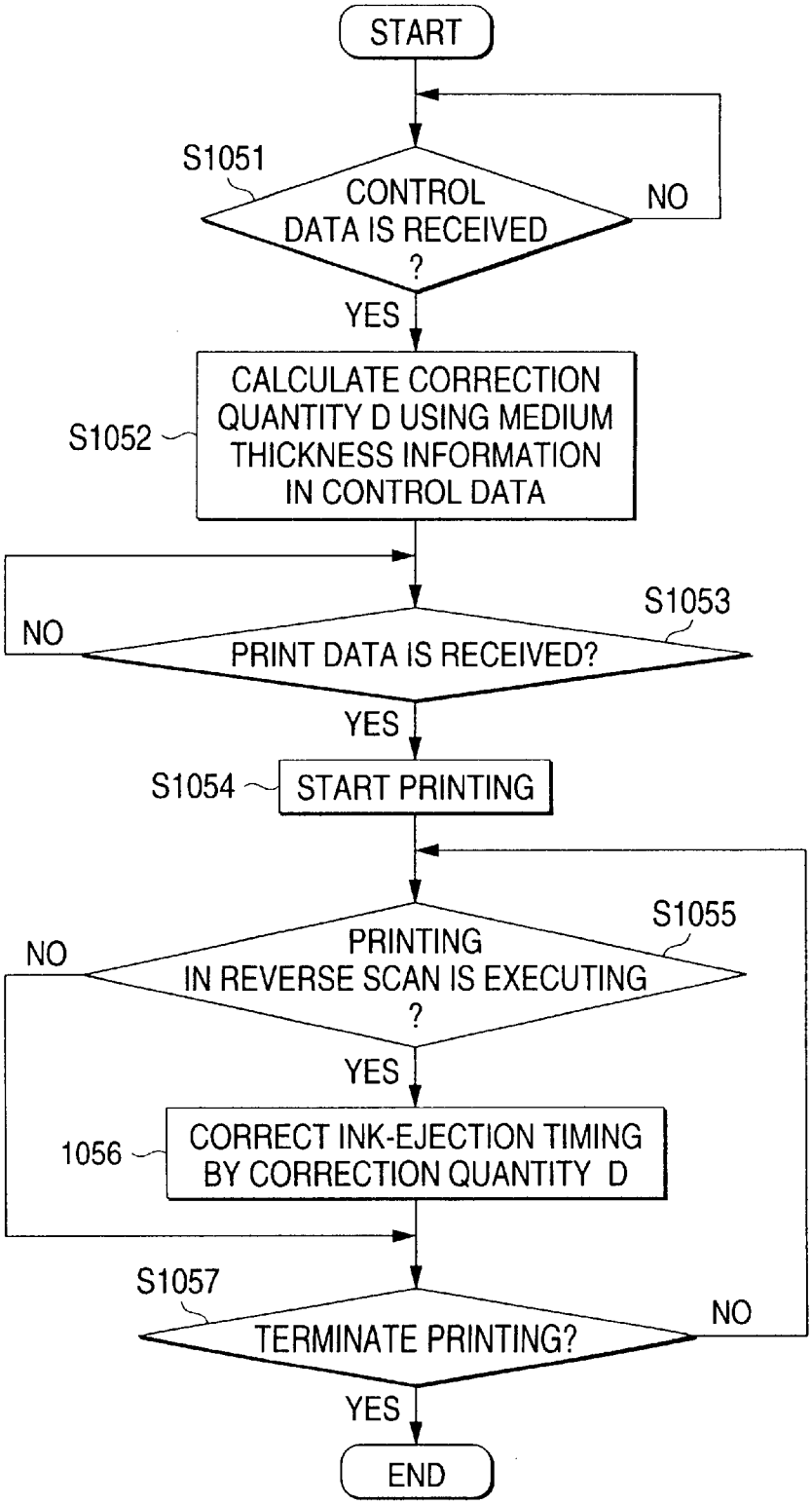
FIG. 18 is a flow chart for explaining an operation of the printer 2 when print data is printed on a printing medium in the second embodiment.

FIG. 18 is a flow chart for explaining an operation of the printer 2 in the printing system of the second embodiment when print data is printed on the printing medium.

The printer 2 receives the control data from the print controller (its transmission to the apparatus was performed as in FIG. 17), through the interface section 21 (step S1051). Then, the timing correction section 231*a* of the controller section 23 reads out of the storage section 25 a mathematical expression between the medium thickness T and the ejection-timing correction quantity D, which is associated with the print quality mode and printing speed contained in the control data, and the sort of ink detected by the ink sensor 26. The medium thickness T specified by the medium thickness information contained in the control data and the platen gap P ($P_1$ or $P_2$) set by the platen gap adjusting section 221 into the readout mathematical expression, to thereby calculate an ejection-timing correction quantity D in the reverse scan with respect to that in the forward scan (step S1052).

As described referring to FIG. 14, the mathematical expression or formula stored in the storage section 25 must be derived within a linear region where the ejection-timing correction quantity D linearly varies with respect the distance H from the surface of a printing medium to be under printing to the ink ejecting surface of the recording head. To this end, the thickness $T_1$ of the reference printing medium and the platen gaps $P_1$ and $P_2$ are selected so as to secure the linear region. Therefore, in order to calculate the ejection-timing correction quantity D within the linear region where the ejection-timing correction quantity D linearly varies with respect the distance H from the medium surface to the ink ejecting surface of the recording head in the step S1052, it is preferable to set the platen gap P in accordance with the medium thickness T of the printing medium set to the printer 2 so that $$(P_2-T_2)<(P-T)<(P_1-T_1) \text{ viz., } D_2<D<D_1.$$

The platen gap may be set to $P_1$ or $P_2$ by controlling the platen gap adjusting section 221 by the controller section 23 in accordance with the medium thickness T specified by the medium thickness information contained in the control data received from the print controller 1.

Following the calculating of the ejection-timing correction quantity D, the controller section 23 receives the print data through the interface section 21, and controls the printer engine section 22 so that it prints the print data on the printing medium in a bi-directional printing mode. Then, printing of the print data starts (step S1054).

During the printing of the print data, the controller section 23 monitors a moving direction of the recording head, and to check if the current printing is by the reverse scan (step S1055). When the present printing operation is by the reverse scan, it off-sets an ink ejection timing (ink ejecting position) of the recording head in the reverse scan with respect to that in the forward scan (step S1056) by the ejection-timing correction quantity D (calculated in the step S1052). This process (steps S1055 and S1056) is repeated till the printing of the print data on the printing medium ends (step S1057).

The printing system of the second embodiment is thus constructed and operated.

As described above, the printer 2 stores a formula describing a relation between the medium thickness T and the ejection-timing correction quantity D in the reverse scan with respect to that in the forward scan in the related memory. An ejection-timing correction quantity D is calculated in accordance with the medium thickness T of a printing medium to be under printing, and the calculated one is used for correcting the ink ejection timings in the forward and reverse scans when the apparatus operates in the bi-directional printing mode.

In this way, the printing system corrects a printing-position off-set between the forward and reverse scans, which inevitably occurs when printing is performed on various printing media of different thickness values in the bi-directional printing mode.

The ejection-timing correction quantity D for the medium thickness T of a printing medium to be under printing is calculated by use of the formula prepared in advance. The capacity of the memory for storing the ejection-timing correction quantities may be reduced when comparing with a case where the ejection-timing correction quantities are prestored in connection with various printing media of different thickness values.

In the present embodiment, the pattern-print control section 232*a* sets the platen gaps $P_1$ and $P_2$ by the platen gap adjusting section 221 in accordance with the operator's instruction, and a test pattern for detecting the ejection-timing correction quantity D is printed. The instruction receiving section 24 receives the print result of the test pattern, and the timing correction section 231*a* derives the formula by use of the ejection-timing correction quantity $D_1$ at the platen gap $P_1$ and the ejection-timing correction quantity $D_2$ at the platen gap $P_2$, which are specified by the print result, and the thickness $T_1$ of the reference printing medium bearing the test pattern printed thereon.

In this way, test patterns are printed on a printing medium (reference printing medium) of a known thickness value $T_1$ at the two platen gaps $P_1$ and $P_2$, and the formula describing a relation between the medium thickness T and the ejection-timing correction quantity D in the reverse scan with respect to that in the forward scan is derived. Accordingly, complicated operations are not required for the operator in deriving the formula.

In the second embodiment mentioned above, the formula is derived by use of the print result of the test patterns printed on the printing medium (reference printing medium) of a predetermined thickness value $T_1$. An alternative is possible. When the test-pattern print-result registering instruction is received in the step S1004 shown in FIG. 16, the medium thickness may be input to the instruction receiving section 24, in addition to the print quality mode and the printing speed. In this case, the formulae may be derived by use of test patterns printed on various printing media.

In the second embodiment mentioned above, the information on the medium thickness T, used for calculating the ejection-timing correction quantity D by use of the formula is acquired from the control data transmitted from the print controller 1. In an alternative, it may be acquired through the instruction receiving section 24. Another alternative is that a medium thick sensor (e.g., photo sensor) for detecting a thickness of a printing medium set onto the platen is provided, and the thickness information is obtained from the sensor.

In the second embodiment, to derive the formula, the platen gaps are adjusted at two steps $P_1$ and $P_2$ by the platen gap adjusting section 221, and the ejection-timing correction quantities $D_1$ and $D_2$ specified by the test patterns printed at those gaps are used for deriving the formula. In a case where the platen gap adjusting section 221 is capable of setting the platen gap at three steps or larger, the ejection-timing correction quantities $D_1$ to $D_n$ ($3 \geqq n$) specified by the results of printing the test patterns at the respective platen gaps are used for deriving the formula. In this case, a plurality of formulae are generated, which are obtained by putting two of the ejection-timing correction quantities $D_1$ to $D_n$ specified by the results of printing the test patterns at the three or larger number of platen gaps, into the equation (1) or (2). The result of averaging those formulae may be used for the formula describing the relation of the medium thickness and an ejection-timing correction quantity in the reverse scan with respect to that in the forward scan.

In the above instance, the platen gap is adjusted at a multiple of steps; the ejection-timing correction quantities specified by the results of printing test patterns at those platen gaps are used for deriving the formulae. An alternative, the platen gap is set at a fixed value, test patterns are printed on printing media of different thickness values, and the ejection-timing correction quantities for those printing media specified by the results of printing the test pattern are used for deriving the formula describing a relation between the medium thickness and the ejection-timing correction quantity in the reverse scan with respect to that in the forward scan.

To be more specific, test patterns are printed on at least two printing media of known thickness values under control of the pattern-print control section 232*a*; the print results are input to the instruction receiving section 24 and the timing correction section 231*a* derives the formula describing the relation between the medium thickness and the ejection-timing correction quantity.

When test patterns are printed on printing media of different thickness values $T_1$ and $T_2$, the formula between the medium thickness T and the ejection-timing correction quantity D is given by $$D = \frac{D_1 - D_2}{(P - T_1) - (P - T_2)}(P - T) + \frac{D_1(P - T_2) - D_2(P - T_1)}{(P - T_2) - (P - T_1)} = \frac{D_1 - D_2}{T_2 - T_1}(P - T) + \frac{D_1(P - T_2) - D_2(P - T_1)}{T_1 - T_2} \quad (3)$$

The expression (3) is approximately expressed as $$D = \frac{D_1 - D_2}{T_2 - T_1}T + \frac{D_2T_1 - D_1T_2}{T_1 - T_2} \quad (4)$$

where $D_1$: ejection-timing correction quantity specified by the result of printing the test pattern on a printing medium of the thickness $T_1$;

$D_2$: ejection-timing correction quantity specified by the result of printing the test pattern on a printing medium of the thickness $T_2$; and P: platen gap.

The formulae (3) an (4), like the formulae (1) and (2), hold in the linear region where the ejection-timing correction quantity linearly varies with respect to the distance from the medium surface to the ink ejecting surface of the recording head. Therefore, the thickness values $T_1$ and $T_2$ of two printing media are preferably selected so as to derive the formula (or formulae) in the linear region where the ejection-timing correction quantity D linearly varies with respect to the distance H from the medium surface to the ink ejecting surface of the recording head. To calculate the ejection-timing correction quantity by use of the formula, it is preferable to use a printing medium of which the thickness T satisfies $(P-T_2)<(P-T)<(P-T_1)$.

Also in the second embodiment, the ejection-timing correction quantity may be detected while allowing for a temperature of the recording head as in the first embodiment. In this case, in the steps S1001 to 1002 (FIG. 16), a temperature of the recording head is detected by the thermal sensor 28 when the test pattern printing is performed, and a detected head temperature is printed as one of the printing conditions, together with the print quality mode, the printing speed and the platen gap. When receiving the print results of the test patterns in the steps S1003 and S1040, the head temperature is received, together with the print quality mode, the printing speed and the platen gap. In the step S1007, the head temperature received from the operator is applied to the formula derived in the step S1006, and the resultant is stored into the storage section 25, in connection with the combination of the print quality mode, the printing speed and the sort of ink.

In the step S1052 shown in FIG. 18, the timing correction section 231*a* reads out the head temperature associated with the formula for calculating the ejection-timing correction quantity D from the storage section 25, and a temperature correction quantity d3 described in the first embodiment is calculated where T is the readout head temperature. Then, a temperature correction quantity d3, which is described in the first embodiment, is calculated where T is the current head temperature detected by the thermal sensor 28. Thereafter, a difference between the temperature correction quantity d3 when T is the head temperature associated with the formula for calculating an ejection-timing correction quantity D, and the temperature correction quantity d3 when T is the current head temperature detected by the thermal sensor 28, is calculated, and the resultant difference is added to the calculated ejection-timing correction quantity D, to thereby correct the calculated ejection-timing correction quantity D.

In this way, the ejection-timing correction quantity D calculated by use of the formula can be corrected in consideration with the current head temperature detected by the thermal sensor 28. The correction of the ejection-timing correction quantity D by the head temperature may be carried out every time the recording head returns to the home position during the printing operation, as in the first embodiment. Alternatively, a head temperature is detected in real time, manner, and an ejection-timing correction quantity D in the reverse scan with respect to that in the forward scan is corrected also in real time by use of the measurement result. The test pattern shown in FIG. 15 is also a typical example, and it may be substituted by any other pattern if it is able to detect the medium thickness.

In the embodiments mentioned above, an off-set quantity of an ink ejecting positions in the reverse scan with respect to that in the forward scan is used for the ejection-timing correction quantity D. Any ejection-timing correction quantity to be calculated may be used if it is capable of correcting an ink ejection timing in at least one of the forward and reverse scans.

As seen from the foregoing description, the present invention is capable of lessening a stress imposed on the operator when the apparatus prints on various types of printing media in the bi-directional printing mode.

What is claimed is:

1. A printer capable of printing on a printing medium in both a forward scan and a reverse scan by a recording head for ejecting ink drops, comprising:

interface means for acquiring control information containing at least information on a thickness of the printing medium, from a print controller which is provided outside the printer and transmits print data for causing the printer to perform the printing; and timing correction means for correcting timings of ejecting ink drops toward the printing medium during at least one of the forward and reverse scans in accordance with the thickness information of the printing medium contained in the control information acquired by the interface means.

2. A printer as set forth in claim 1, wherein the control information contains information on an ink ejecting velocity and information on a moving velocity of the recording head, and wherein the timing correction means corrects timing of ejecting ink drops to the printing medium in accordance with the information on a thickness of the printing medium, an ink ejecting velocity and a moving velocity of the recording head, those information being contained in the control information acquired by the interface means.

3. A printer as set forth in claim 1, further comprising:

test pattern printing means for printing a test pattern to detect a thickness of a printing medium in accordance with an instruction of an operator;

storing means for storing a table containing a correspondence between the result of printing the test pattern and information on a thickness of the printing medium;

reception means for receiving an operators instruction to register the printing result of the test pattern; and registering means for registering plural pieces of information to specify the printing result of the test pattern received by the reception means, wherein the reception means further receives an instruction to select one of the plural pieces of information registered in the registering means, and wherein the interface means searches for information on the thickness of the printing medium in the table stored in the storing means, which is associated with the printing result of the test pattern specified by the instruction which selects one of the plural pieces of information, and acquires searched information as the control information.

4. A printer as set forth in claim 1, wherein the timing correction means includes:

storing means for storing a mathematical expression describing a relation of a thickness of the printing medium with an ejection-timing correction quantity during at least one of the forward and reverse 'scans;

correction-quantity calculating means for calculating an ejection-timing correction quantity dependent on a thickness of the printing medium under printing by use of the expression; and timing control means for controlling a timing to eject an ink drop onto the printing medium to be under printing in at least one of the forward and reverse scans in accordance with an ejection-timing correction quantity calculated by the correction quantity calculating means.

5. A printer as set forth in any one of claims 1 to 4, further comprising head temperature detecting means for detecting temperature of the recording head, wherein the timing correction means corrects a timing of ejecting an ink drop to the printing medium to be under printing while additionally considering a head temperature detected by the head temperature detecting means.

6. The printer as set fourth in claim 4, wherein the ejection-timing correction quantity is a value produced directly by the expression.

7. A printer as set forth in claim 1, further comprising head temperature detecting means for detecting temperature of the recording head, wherein the timing correction means includes:

timing-correction-quantity determining means for determining, prior to a start of printing on the printing medium, an ejecting-timing correction quantity of a timing of ejecting an ink drop to the printing medium in accordance with information on a thickness of the printing medium, which is contained in control information acquired by the interface means;

correction quantity adjusting means for adjusting the ejection-timing correction quantity, which is determined by the timing-correction-quantity determining means on the basis of the head temperature detected by the head temperature detecting means; and timing control means for controlling a timing of ejecting an ink drops to the printing medium in at least one of the forward and reverse scans in accordance with the timing-correction quantity adjusted by the correction quantity adjusting means, and wherein the correction quantity adjusting means acquires the head temperature detected by the head temperature detecting means every time the recording head reaches a home position, and adjusts the ejection-timing correction quantity determined by the timing-correction-quantity determining means.

8. A printer capable of printing on a printing medium in both a forward scan and a reverse scan by a recording head for ejecting ink drops, comprising:

storing means for storing a mathematical expression describing a relation of a thickness of the printing medium with an ejection-timing correction quantity during at least one of the forward and reverse scans;

correction-quantity calculating means for calculating an ejection-timing correction quantity dependent on a thickness of the printing medium to be under printing by use of the expression, and timing control means for controlling a timing to eject an ink drop onto the printing medium to be under printing in at least one of the forward and reverse scans in accordance with an ejection-timing correction quantity calculated by the correction-quantity calculating means.

9. The printer as set forth in claim 8, further comprising expression deriving means for deriving the expression to be stored into the storing means on the basis of an ejection-timing correction quantity previously derived in at least one of the forward and reverse scans of a bi-directional printing executed by the recording head, with respect to at least two printing media having different thicknesses.

10. The printer as set forth in claim 9, further comprising:

test pattern printing means for printing a test pattern used for detecting an ejection-timing correction quantity in at least one of the forward and reverse scans of a bi-directional printing executed by the recording head with respect to at least two printing media in response to an operator's instruction;

storing means for storing a table containing a correspondence between results of printing the test patterns and ejection-timing correction quantities; and reception means for receiving at least two data representative of test pattern printing results of the printing media having different thicknesses, from the operator, wherein the expression deriving means derives the expression on the basis of thicknesses of the at least two printing media, and ejection-timing correction quantities derived from the table stored in the storage means through use of the data received by the input means.

11. The printer as set forth in claim 9, wherein the expression deriving means derives the following mathematical expression in a case where the bi-directional printing is executed with respect to two printing media of different thickness values $T_1$ and $T_2$:

$$D = \frac{D_1 - D_2}{(P - T_1) - (P - T_2)}(P - T) + \frac{D_1(P - T_2) - D_2(P - T_1)}{(P - T_2) - (P - T_1)}$$

where

D: ejecting-timing correction quantity in at least one of the forward and reverse scans when the printer prints on the printing medium to be under printing in the bi-directional printing mode;

T: thickness of the printing medium to be under printing;

P: distance from an ink ejection surface of the recording head to a platen supporting the printing medium; and $D_1$ and $D_2$: ejection-timing quantities in at least one of the forward and reverse scans executed by the recording head when the printer prints on two printing media of different thickness values $T_1$ and $T_2$ in the bi-directional printing mode.

12. The printer as set forth in claim 8, further comprising:

position adjusting means for setting a platen gap defined as a distance from an ink ejection surface of the recording head to a platen supporting the printing medium into one of at least two values by moving at least one of the platen and the printing medium; and expression deriving means for deriving a mathematical expression to be stored in the storing means on the basis of an ejection-timing correction quantity previously derived in at least one of the forward and reverse scans when the printer prints on a printing medium of a predetermined thickness in the bi-directional printing mode for each of the platen gaps.

13. The printer as set forth in claim 12, further comprising:

test pattern printing means for printing at least two test patterns with respect to different platen gaps while controlling the position adjusting means, in accordance with an instruction by an operator;

storing means for storing a table containing the correspondence between the printing results of the test patterns and the ejection-timing correction quantities; and reception means for receiving data representative of test pattern printing results associated with the at least two platen gaps, from the operator, wherein the expression deriving means derives the expression on the basis of at least two platen gaps set by the position adjusting means, the ejection-timing correction quantities derived from the table stored in the storage means through use of the data received by the input means, and a thickness of the printing medium on which the test patterns are printed.

14. The printer as set forth in claim 12, wherein the expression deriving means derives the following mathematical expression in a case where the bi-directional printing is executed on the printing medium of predetermined thickness $T_1$ for different platen gaps $P_1$ and $P_2$ set by the position adjusting means:

$$D = \frac{D_1 - D_2}{(P_1 - T_1) - (P_2 - T_1)}(P - T) + \frac{D_1(P_2 - T_1) - D_2(P_1 - T_1)}{(P_2 - T_1) - (P_1 - T_1)}$$

where

D: ejecting-timing correction quantity in at least one of the forward and reverse scans when the printer prints on the printing medium to be under printing in the bi-directional printing mode;

T: thickness of the printing medium to be under printing;

P: platen gap when the printer prints on the printing medium to be under printing in the bi-directional printing mode; and $D_1$ and $D_2$: ejection-timing quantities in at least one of the forward and reverse scans when the printer prints on the printing medium of thickness value $T_1$ in the bi-directional printing mode.

15. The printer as set forth in any one of claims 8 to 14, further comprising temperature detecting means for detecting temperature of the recording head, wherein the timing control means corrects a timing of ejecting an ink drop to the printing medium to be under printing while additionally considering a head temperature detected by the head temperature detecting means.

16. The printer as set forth in claim 8, further comprising:

temperature detecting means for detecting temperature of the recording head; and correction quantity adjusting means for adjusting an ejection-timing correction quantity calculated by the correction quantity calculating means on the basis of a head temperature detected by the head temperature detecting means, wherein the timing control means controls a timing of ejecting an ink drop to the printing medium to be under printing in at least one of the forward and reverse scans in accordance with the ejection-timing correction quantity adjusted by the correction quantity adjusting means, and wherein the correction quantity adjusting means adjusts the ejection-timing correction quantity calculated by the correction quantity calculating means in accordance with a heat temperature, which is acquired by the correction quantity adjusting means every time the recording head reaches a home position.

17. The printing method as set forth in claim 8, wherein the ejection-timing correction quantity is a value produced directly by the expression.

18. A printer capable of printing on a printing medium in both a forward scan and a reverse scan by a recording head for ejecting ink drops, comprising:

temperature detecting means for detecting temperature of the recording head; and timing correction means for correcting a timing of ejecting an ink drop to the printing medium in at least one of the forward and reverse scans in accordance with the temperature of the recording head detected by the head temperature detecting means, wherein the timing correction means acquires the head temperature detected by the head temperature detecting means every time the recording head reaches a home position, and adjusts the ejection-timing correction quantity determined by the timing-correction-quantity determining means.

19. A printing system comprising:

a printer capable of printing on a printing medium in both a forward scan and a reverse scan by a recording head for ejecting ink drops, the printer including timing correction means for correcting a timing of ejecting an ink drop to the printing medium in at least one of the forward and reverse scans; and a print controller provided outside the printer, the print controller including transmitting means for transmitting print data and print data control information containing at least information on a thickness of the printing medium to the printer, wherein the print data control information is transmitted to the printer prior to transmission of the print data, and wherein the timing correction means corrects the ejection timing in accordance with the print data control information.

20. The printing system as set forth in claim 19, wherein the control information contains information on an ink ejecting velocity and information on a moving velocity of the recording head, and wherein the timing correction means corrects timing of ejecting ink drops to the printing medium in accordance with information on a thickness of the printing medium, information on an ink ejecting velocity, and information on a moving velocity of the recording head, those information being contained in the print data control information received from the print controller.

21. The printing system as set forth in claim 19 or 20, wherein the print controller includes storing means for storing information of the thicknesses of a plurality of printing media, and reception means for receiving an instruction to select one of the thickness information of the printing media stored in the storing means, and wherein the transmitting means transmits, prior to transmission of print data, the medium thickness information selected by the instruction received by the reception means to the printer in a state that the thickness information is contained in the print data control information.

22. A recording medium for storing a print control program for controlling a printer capable of printing on a printing medium in both a forward scan and a reverse scan by a recording head for ejecting ink drops, the print control program causes an information processor provided with a print controller which is provided outside the printer to execute the steps of:

receiving an instruction to select one of plural printing media;

reading out information on a thickness of the printing medium selected by the received instruction, prior to print data transmission to the printer, from a table containing information on the plural printing media and the thickness information thereof respectively associated with each other; and transmitting the readout thickness information to the printer in a state that the thickness information is contained in the print data control information.

23. The recording medium as set forth in claim 22, wherein information on a velocity value of ejecting an ink drop onto the printing medium selected by the instruction received in the instruction receiving step is further read out from a table containing information on the plural printing media and ink-ejection velocity values respectively associated with each other in the information reading step in order to transmit the velocity value information to the printer in a state that the velocity value information is contained in the print data control information.

24. A method of printing on a printing medium by both a forward scan and a reverse scan by a recording head for ejecting an ink drop, comprising the steps of:

preparing a mathematical expression describing a relation between a thickness of the printing medium and an ejection-timing correction quantity in at least one of the forward and reverse scans;

calculating an ejection-timing correction quantity dependent on the thickness of the printing medium to be under printing by use of the expression; and correcting an ink-drop ejection timing in at least one of the forward and reverse scans when printing on the printing medium to be under printing is performed in a bi-directional printing mode.

25. The printing method as set forth in claim 24, wherein the step of correcting an ink-drop ejection timing is performed while additionally considering a temperature of the recording head.

26. The printing method as set forth in claim 24, wherein the step of correcting an ink-drop ejection timing is performed while additionally considering a temperature of the recording head.

27. The printing method as set forth in claim 24, wherein the ejection-timing correction quantity is a value produced directly by the expression.

28. A printer capable of printing on a printing medium in both a forward scan and a reverse scan by a recording head for ejecting ink drops, comprising:

storing means for storing a mathematical expression describing a relation of a thickness of the printing medium with an ejection-timing correction quantity during at least one of the forward and reverse scans;

correction-quantity calculating means for calculating an ejection-timing correction quantity dependent on a thickness of the printing medium to be under printing by use of the expression;

timing control means for controlling a timing to eject an ink drop onto the printing medium to be under printing in at least one of the forward and reverse scans in accordance with an ejection-timing correction quantity calculated by the correction-quantity calculating means; and expression deriving means for deriving the expression to be stored into the storing means on the basis of an ejection-timing correction quantity previously derived in at least one of the forward and reverse scans of a bi-directional printing executed by the recording head, with respect to at least two printing media having different thicknesses, wherein the expression deriving means derives the following mathematical expression in a case where the bi-directional printing is executed with respect to two printing media of different thickness values $T_1$ and $T_2$:

$$D = \frac{D_1 - D_2}{(P - T_1) - (P - T_2)}(P - T) + \frac{D_1(P - T_2) - D_2(P - T_1)}{(P - T_2) - (P - T_1)}$$

where

D: ejecting-timing correction quantity in at least one of the forward and reverse scans when the printer prints on the printing medium to be under printing in the bi-directional printing mode;

T: thickness of the printing medium to be under printing;

P: distance from an ink ejection surface of the recording head to a platen supporting the printing medium; and $D_1$ and $D_2$: ejection-timing quantities in at least one of the forward and reverse scans executed by the recording head when the printer prints on two printing media of different thickness values $T_1$ and $T_2$ in the bi-directional printing mode.

29. The printer as set forth in claim 28, further comprising temperature detecting means for detecting temperature of the recording head, wherein the timing control means corrects a timing of ejecting an ink drop to the printing medium to be under printing while additionally considering a head temperature detected by the head temperature detecting means.

30. A printer capable of printing on a printing medium in both a forward scan and a reverse scan by a recording head for ejecting ink drops, comprising:

storing means for storing a mathematical expression describing a relation of a thickness of the printing medium with an ejection-timing correction quantity during at least one of the forward and reverse scans;

correction-quantity calculating means for calculating an ejection-timing correction quantity dependent on a thickness of the printing medium to be under printing by use of the expression;

timing control means for controlling a timing to eject an ink drop onto the printing medium to be under printing in at least one of the forward and reverse scans in accordance with an ejection-timing correction quantity calculated by the correction-quantity calculating means;

position adjusting means for setting a platen gap defined as a distance from an ink ejection surface of the recording head to a platen supporting the printing medium into one of at least two values by moving at least one of the platen and the printing medium; and expression deriving means for deriving a mathematical expression to be stored in the storing means on the basis of an ejection-timing correction quantity previously derived in at least one of the forward and reverse scans when the printer prints on a printing medium of a predetermined thickness in the bi-directional printing mode for each of the platen gaps, wherein the expression deriving means derives the following mathematical expression in a case where the bi-directional printing is executed on the printing medium of predetermined thickness $T_1$ for different platen gaps $P_1$ and $P_2$ set by the position adjusting means:

$$D = \frac{D_1 - D_2}{(P_1 - T_1) - (P_2 - T_1)}(P - T) + \frac{D_1(P_2 - T_1) - D_2(P_1 - T_1)}{(P_2 - T_1) - (P_1 - T_1)}$$

where

D: ejecting-timing correction quantity in at least one of the forward and reverse scans when the printer prints on the printing medium to be under printing in the bi-directional printing mode;

T: thickness of the printing medium to be under printing;

P: platen gap when the printer prints on the printing medium to be under printing in the bi-directional printing mode; and $D_1$ and $D_2$: ejection-timing quantities in at least one of the forward and reverse scans when the printer prints on the printing medium of thickness value $T_1$ in the bi-directional printing mode.

31. The printer as set forth in claim 30, further comprising temperature detecting means for detecting temperature of the recording head, wherein the timing control means corrects a timing of ejecting an ink drop to the printing medium to be under printing while additionally considering a head temperature detected by the head temperature detecting means.

* * * * *